US007706980B2

(12) United States Patent
Winters et al.

(10) Patent No.: US 7,706,980 B2
(45) Date of Patent: Apr. 27, 2010

(54) BLOWOUT PREVENTER TESTING SYSTEM AND METHOD

(75) Inventors: Warren J. Winters, Cypress, TX (US); Ronald B. Livesay, Fort Worth, TX (US)

(73) Assignee: BP Corporation North America Inc., Warrenville, IL (US)

( * ) Notice: Subject to any disclaimer, the term of this patent is extended or adjusted under 35 U.S.C. 154(b) by 73 days.

(21) Appl. No.: 11/931,862

(22) Filed: Oct. 31, 2007

(65) Prior Publication Data

US 2008/0185143 A1 Aug. 7, 2008

Related U.S. Application Data

(60) Provisional application No. 60/887,739, filed on Feb. 1, 2007.

(51) Int. Cl.
*G01V 1/40* (2006.01)

(52) U.S. Cl. ..... 702/9; 702/2; 702/6; 702/12

(58) Field of Classification Search ..... 702/1, 702/2, 6, 9, 45, 50, 51, 127, 138, 140, 187, 702/189, 12, 98, 100; 73/152.51–152.54; 166/363, 85.4, 297; 340/500, 540, 603, 604, 340/626, 870.01, 870.07, 870.16

See application file for complete search history.

(56) References Cited

U.S. PATENT DOCUMENTS

| | | | | |
|---|---|---|---|---|
| 2,164,195 | A * | 6/1939 | Waltermire | 73/40.5 R |
| 4,347,733 | A * | 9/1982 | Crain | 73/40.5 R |
| 5,623,680 | A * | 4/1997 | Flora-Holmquist et al. | 712/232 |
| 2003/0033436 | A1 * | 2/2003 | Weiss | 709/310 |
| 2004/0007392 | A1 * | 1/2004 | Judge et al. | 175/206 |
| 2004/0059443 | A1 * | 3/2004 | Sharangpani | 700/48 |
| 2005/0096848 | A1 * | 5/2005 | Hou et al. | 702/9 |
| 2005/0269079 | A1 * | 12/2005 | Franklin | 166/250.07 |

OTHER PUBLICATIONS

James H. Stapleton, Linear Statistical Models, 1995, John Wiley & Sons, Inc., p. 145-152.*

* cited by examiner

*Primary Examiner*—Drew A Dunn
*Assistant Examiner*—Manko Cheung
(74) *Attorney, Agent, or Firm*—James A. Gabala; John L. Wood

(57) ABSTRACT

A method and apparatus for testing a blowout preventer (BOP) wherein a pressurization unit applies fluid to an isolated portion of the throughbore of the BOP. A signal that is representative of the actual pressure in the isolated portion of the throughbore over successive time points and a pre-determined non-deterministic finite state automaton are used to predict the pressure in the isolated portion of the throughbore as a function of time relative to a pre-determined acceptable leak rate and the time at which stability is achieved. In one embodiment stability is achieved when successive predicted pressures are within a predetermined difference over a pre-determined interval of time. Visual indications are provided to depict the progress of testing.

24 Claims, 15 Drawing Sheets

Test data processed with
Software developed by BP America Inc.

Test data processed with software developed by BP America Inc.

Test data processed with software developed by BP America Inc.

Test data processed with software developed by BP America Inc.

Test data processed with
Software developed by BP America Inc.

High Pressure Tests - Current Test
Yellow
Pressure (psi)
10,200
10,100
10,000
9,900
9,800
9,700
9,600
9,500
9,400
9,300
9,200
Incoming (yellow)
Test Pressure
23:45:00
23:50:00
23:55:00
00:00:00
00:05:00
00:10:00
00:15:00
00:20:00
00:25:00
Incoming (yellow) Incoming (green) Incoming (red) Forecast Test Pressure
Test data processed with software developed by BP America Inc.

High Pressure Tests - Current Test

BLOWOUT PREVENTER TESTING SYSTEM AND METHOD

CROSS-REFERENCE TO RELATED APPLICATIONS

This Patent Application is related to a pending U.S. patent application filed on Dec. 22, 2004 under Ser. No. 11/025,415 and published as 2005/0269079 on Dec. 8, 2005. The teachings therein are incorporated herein by reference. This patent application claims the priority of a USA Provisional Patent Application filed on Feb. 1, 2007 under Ser. No. 60/887,739 and entitled "Improved Blowout Preventer System."

TECHNICAL FIELD

This invention relates to the general subject of production of oil and gas and, in particular, to methods and apparatuses for testing fluid systems.

BACKGROUND OF THE INVENTION

Current subsea Blow Out Preventer (BOP) testing practice (in U.S. "Oil and Gas Drilling Operation," Subpart D, 30 C.F.R. Chapter II, current Edition; and generally worldwide) is to view shut-in test pressures on circular chart recorders and wait until a 5-minute period of reasonably stable pressures is obtained (see FIG. 1). Reasonably stable pressures must be greater than or equal to the required test pressure and allow for temperature-related pressure declines. Tests are initiated well in excess of required pressures. A 5-minute period of reasonably stable pressures is required as proof of non-leaking tests since, absent additional analysis, the periods of overtly declining shut-in pressures could be indicative of leaks in the systems. The basic chart recorder used on a majority of drilling rigs today was patented over one hundred years ago (Wittmer, G. X.: "Recording Apparatus for Fluid Meters," U.S. Pat. No. 716,973).

In the United States under current regulations, subsea BOP tests, recorded on 4-hour 15,000 psi circular charts, are typically ended when pressure decline rates are in the range −4 to −3 psi/min. This is because the pressure trace begins to appear steady once pressure decline rates diminish to the range −4 to −3 psi/min, making this the as-practiced limit of circular chart resolution. Given the subjective nature of visual chart interpretation, tests are sometimes stopped at pressure decline rates as high as −5 psi/min and as low as −2 psi/min. A decline rate of −3 psi/min is representative of a high standard of current testing practice. The pressure at which this occurs is defined as $P_s$ or the "pressure at stabilization."

Industry trends toward deeper water, synthetic oil-based fluids, and subsurface conditions requiring increasingly higher test pressures all contribute to lengthy delays while waiting for pressures to stabilize during subsea BOP testing. Also, subsea BOP stacks with redundancy of components and use of multiple-diameter drill strings leads to greater numbers of tests that must be conducted.

An investigation of the phenomenon of lengthy subsea BOP testing times (see Franklin, C. M., Vargo, R. F., Sathuvalli, U. B. and Payne, M. L.: "Advanced Analysis Identifies Greater Efficiency for Testing BOPs in Deep Water," *SPEDC* [December 2005] 242-250) conclusively attributed the prolonged decay of pressure with time to heating of the test fluids during pressurization followed by cooling of the fluids during shut-in test periods. They proposed that real time digital analysis of the pressure decay could yield large time and cost savings with safety benefits gained through reduced exposure time of personnel to pressurized lines.

FIG. 2 depicts an example of the basic components involved in testing a subsea BOP stack 8. A drill string tool or test plug 9 is lowered into the interior or throughbore of the BOP and it seats at the lower end of the BOP to seal off the well components further down the wellbore. The system is a pressure vessel comprised of the test line 10 from the Cementing Unit (CU) 12 and the drillpipe 14 from the surface 13 of the rig 16 down to the BOP stack 8 at the mudline 20. In this work, the capacity of the BOP pressure vessel is referred to as the "test volume" (i.e. an isolated portion of the throughbore of the BOP). A choke line 24 and a kill line 26 connect the throughbore at the interior of the BOP to the CU 12. The valves (e.g., annular preventers, pipe rams, shear rams, etc.) 22 in the BOP stack are tested in sequence by closing each valve and then pumping fluid from the CU into the test volume until a "target pressure" is reached (i.e. the "pumping phase"). At the target pressure, pumping stops and the pressure in the test volume is monitored until the test is deemed valid (i.e. the "shut-in phase"). In deepwater wells, the duration of the shut-in phase can be as long as 60 minutes when Synthetic Based Muds (SBM's) are used. Pressure testing a BOP with SBM leads to lengthy testing times as a result of pressure/volume/temperature (PVT) influences associated with the fluid properties of SBM. These influences are especially pronounced in deepwater and high-pressure test environments.

In the example of FIG. 3, eight pipe ram tests averaged 53.5 minutes each, four annular preventer tests averaged 16.8 minutes each, and the total shut-in time was 8.25 hours. In the U.S., the ideal combined shut-in time would be one hour given the U.S. Minerals Management Service (MMS) requirement that each of the 12 tests must hold the required pressure for 5 minutes. In this example, an excess of 7.25 hours was expended waiting for pressures to stabilize.

Pressure declines of non-leaking tests may be attributed to cooling of the fluids in the pressurized system:

- Surface-temperature fluids are pumped from the CU into the kill and/or choke line(s) to apply elevated pressure to the subsea BOP components being tested (i.e., these fluids are warmer than their surroundings).
- Fluids in the kill and/or choke line(s) compress as additional fluids are pumped in (i.e., these fluids are displaced deeper to cooler surroundings).
- Fluids in the kill and/or choke line(s) undergo an internal energy rise when they are compressed; this heat of compression causes a slight elevation of fluid temperatures throughout the system.
- The pressurized fluids in the kill and/or choke line(s) cool as they lose heat to their surroundings.
- Shut-in test pressures decline as the testing fluids cool; the rate of pressure decline is fastest initially when the temperature differences ($\Delta T$) between fluids and surroundings are greatest, and slows as $\Delta T$ becomes less.

Subsea BOP tests tend to take longer with synthetic base muds (SBM) than with water base fluids (see FIG. 4) because:

- SBM is more compressible than water, hence more SBM (and heat) is pumped-in to attain a given test pressure.
- SBM has greater heat of compression (temperature rise) than water.
- SBM has lower heat capacity than water so loses heat more slowly and takes longer to cool.

The problem of BOP testing has existed for some time. Considerable time and effort is expended each year to perform BOP tests. In spite of this, and with the exception of the earlier work by Franklin, et al., BOP testing schemes have not progressed in a long time. Actually, the problem has become aggravated with the passage of time because each year more and more testing is conducted at higher pressures using the current time consuming processes.

SUMMARY OF THE INVENTION

In accordance with one embodiment of the present invention, a method is provided for testing a blowout preventer (BOP) having a throughbore between its upper and lower ends, means for isolating a portion of the throughbore and means for providing a signal that is representative of the actual pressure within the isolated portion of the throughbore. The method uses a pressurization unit for applying pressurized fluid to the isolated portion of the throughbore of the BOP, and comprises the steps of: (a) using the signal that is representative of the actual pressure in the isolated portion of the throughbore over successive time points, using a predetermined regression model, having a plurality of constant but un-determined coefficients, to express the pressure in the isolated portion of the throughbore as a function of time, and to solve for the value of the coefficients; (b) using the evaluated coefficients and the regression model to forecast the time when the rate of pressure change in the isolated portion of the throughbore approximates a predetermined rate of pressure change; (c) using the evaluated coefficients, the regression model, and the time of step (b) to forecast the pressure in the isolated portion of the throughbore; (d) repeating the previous steps until successive forecasts of the pressure in the isolated portion of the throughbore stabilize relative to a predetermined convergence test; and (e) producing a visual indication when successive forecasts stabilize.

In one embodiment of the invention, a safety factor is applied by having step (e) further conditioned on Pt/Pf being less than or equal to a predetermined fraction that is derived from testing a representatively large sample of satisfactorily performing BOPs, where "Pt" is the pressure applied to the BOP when monitoring begins, and "Pf" is the current stabilized pressure from step (d).

In another embodiment a further degree of safety is introduced by the added steps of (f): using the evaluated coefficients and the regression model to predict/forecast the time when the pressure in the isolated portion of the throughbore will stabilize relative to a second pre-determined pressure decline rate that is less than the first pre-determined pressure decline rate, and to predict/forecast the pressure "Pz" at such time; and (g) producing a visual indication if (Pf−Pz) is not greater than the product of Pf and "ϵ" where "ϵ" is less than one.

In accordance with yet another aspect of the present invention, an apparatus is provided for testing a blowout preventer. In particular, the apparatus comprises a digital computer that receives a signal that is representative of current pressure within the isolated portion of the throughbore and that is programmed to: (1) regress the signal to $$A + \frac{b}{c + t^m}$$

where A, b, c, and m are coefficients and "t" is time; (2) compute successive sets of coefficients $\{A_{i+1}, b_{i+1}, c_{i+1}, m_{i+1}\}$ from successive signals representative of current pressure within the isolated portion of the throughbore over time; (3) predict the pressure in the isolated portion of the throughbore as a function of time; (4) successively compute the pressure decline rate, the time when a first pre-determined pressure decline rate is achieved, and the pressure in the isolated portion of the throughbore at such time; and (5) signal when successive predicted pressures becomes stable.

The digital BOP testing algorithm has been thoroughly evaluated through retrospective analysis of hundreds of digitally recorded subsea BOP tests conducted in the U.S. Gulf of Mexico. Digital BOP testing software has been run in real time at every opportunity via remote live acquisition of subsea BOP testing data.

Digital BOP testing software performed successfully in trials conducted onboard a deepwater drilling rig in the Gulf of Mexico. Digital analysis was employed concurrent to the chart recorder method of test interpretation which remained the deciding factor. Field trials accomplished the non-trivial challenge to acquire sufficiently high quality data flows and interface to existing signal processing infrastructure onboard floating drilling operations.

The U.S. Minerals Management Service (MMS) was notified of status and results throughout development and trials of digital BOP testing. A proposal was submitted to commence in 2007, a subset of subsea BOP tests to be interpreted using digital analysis in lieu of the chart recorder method. Approval is pending.

Some of the advantages of the invention include simplicity and speed. Recent advances in digital technology and the relative ease of data processing with inexpensive personal computer (PC) technology lead to a clear opportunity for improvement in the recording, analysis, and validation of BOP tests. Numerous other advantages and features of the present invention will become readily apparent from the following detailed description of the invention, the embodiments described therein, from the claims and from the accompanying drawings.

DETAILED DESCRIPTION

Figure 1:
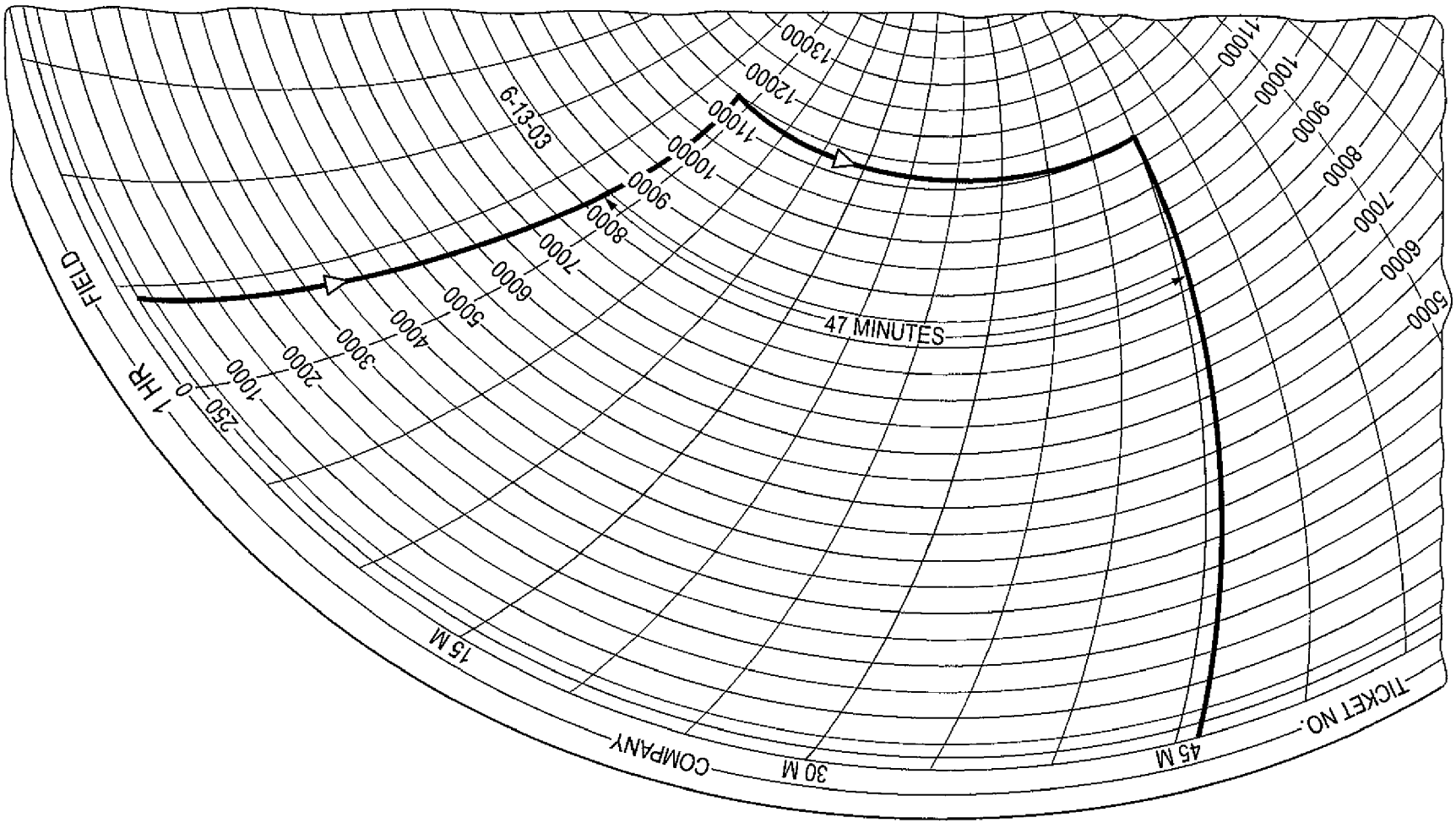
Fig. 1 Prior Art
FIG. 1 depicts a conventional high-pressure subsea BOP test where pressure is held shut-in until a 5-minute period of reasonably stable pressure (when viewed on a 4-hour 15,000 psi circular chart recorder) is obtained.

While this invention is a susceptible embodiment in many different forms, there is shown in the drawings, and will herein be described in detail, one specific embodiment of the invention. It should be understood, however, that the present disclosure is to be considered an exemplification of the principles of the invention and is not intended to limit the invention to any specific embodiment so described.

Digital BOP Testing Algorithm

To enable real time interpretation of subsea blowout preventer tests, a digital BOP testing algorithm was developed. Many specific approaches may be taken; preferably, the algorithm should obtain accurate pressure forecasts and have good predictive capability. The algorithm is used to fit observed or actual pressure data, and a pressure trend is extrapolated. Finally, a test criteria is applied to check for confidence in the pressure forecast.

Figure 2:
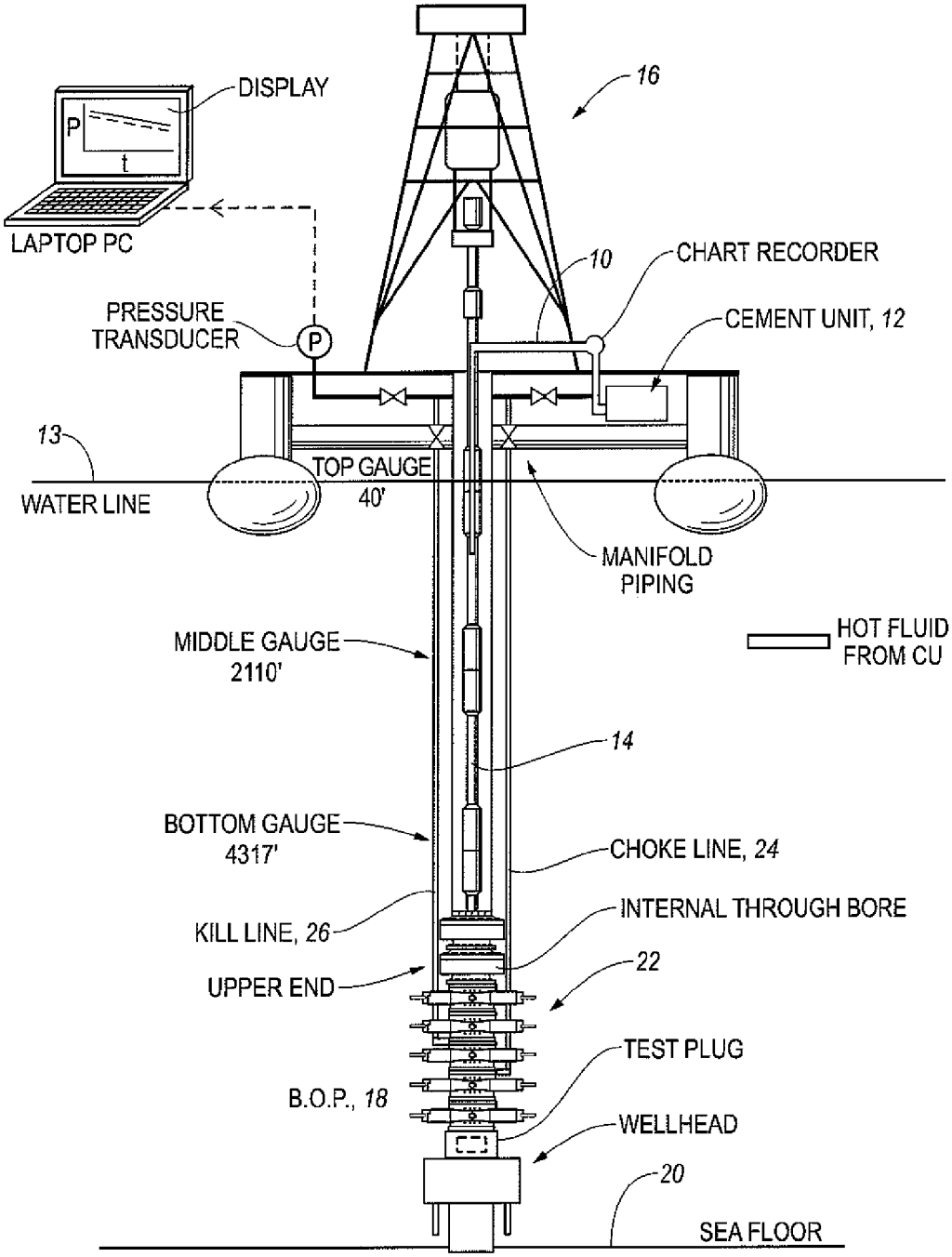
FIG. 2 shows the major components of a BOP test.
Figure 3:
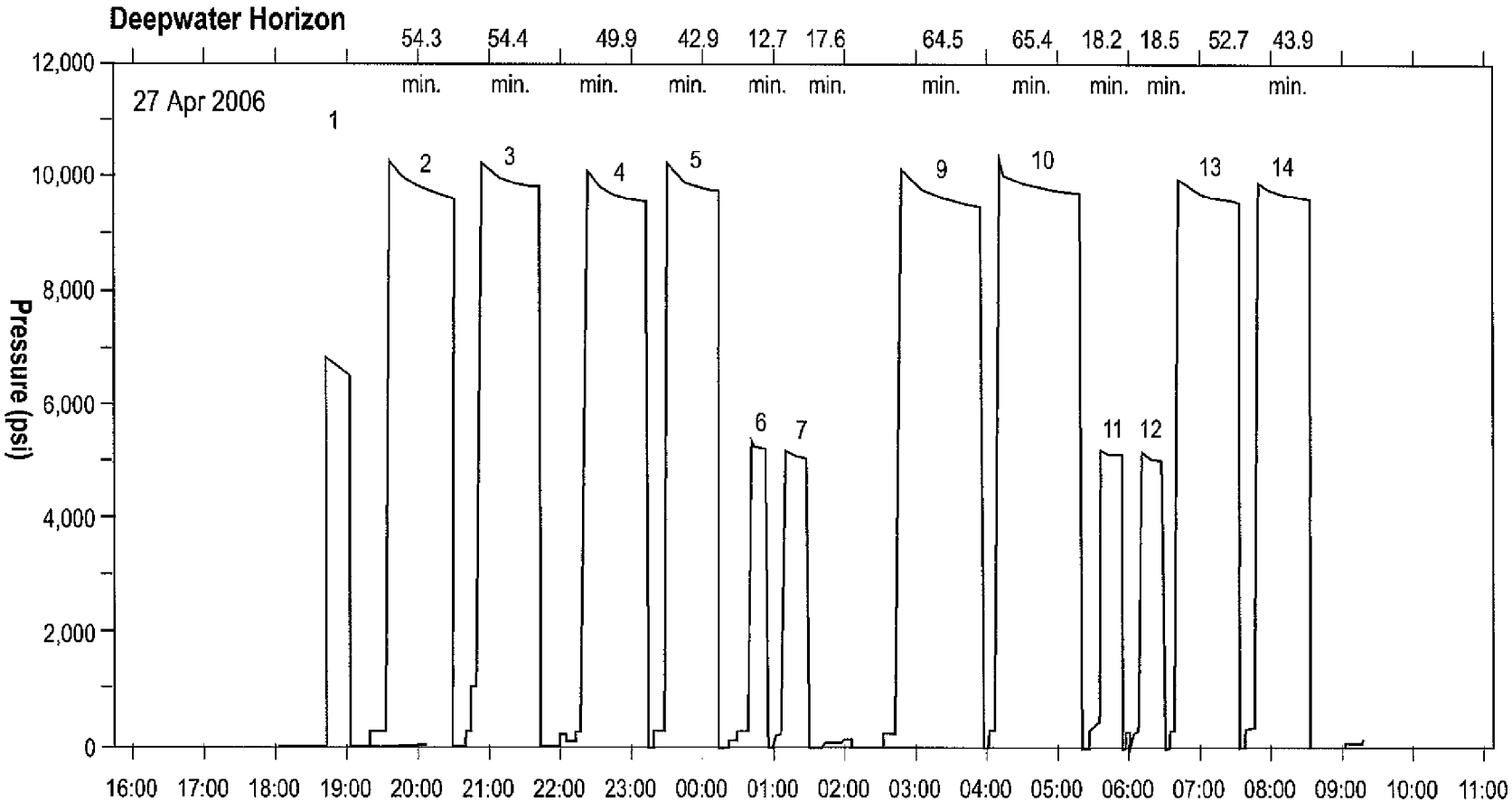
FIG. 3 illustrates a typical series of subsea BOP tests spanning about 14 hours of elapsed time.
Figure 4:
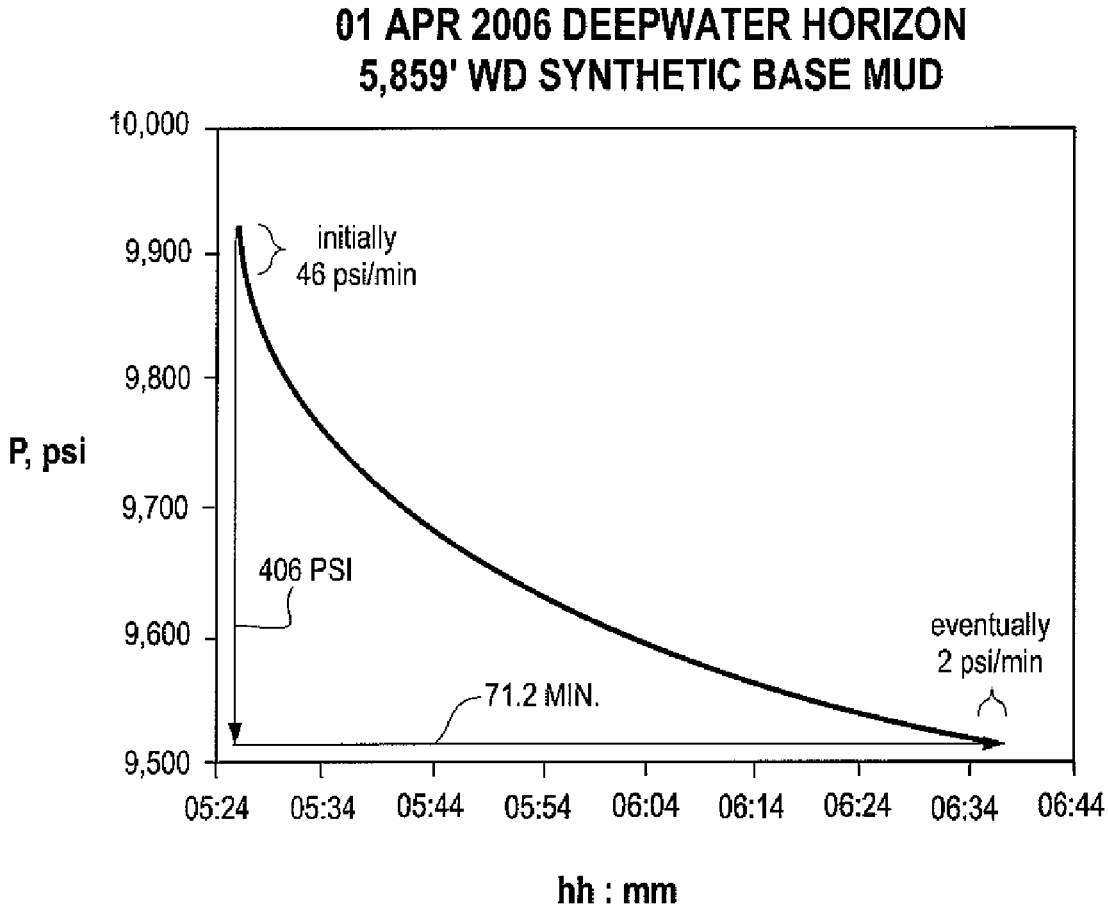
FIG. 4 depicts a subsea BOP test using synthetic base fluids.

Pump rate, volume pumped and pump pressure data are received in approximately 1-second intervals by the computer 50 shown in FIG. 2 after analog to digital conversion 52. These measurements may be made from CUs by cementing services providers. Those skilled in the art know that other pressure measurement sources exist. The end of pumping and beginning of shut-in test periods are detected.

One specific algorithm and process will be described. During shut-in periods, the coefficients of a function of the form:

$$P(t) = A + \frac{b}{c + t^m} \tag{1}$$

are created in a regression of the current population of data {time, pressure} in such a way as to minimize the difference (in a least-squares sense) between the actual data and a computation of Eq. (1) at the same times as the actual data sets regressed to the entire time, and pressure data is set whenever fresh data are received. The values of A, b, c and m that provide the best fit of the function to the data are then computed.

Given that Eq. (1) expresses shut-in test pressure as a function of time, the pressure decline rate is the first derivative of Eq. (1):

$$P'(t) = \frac{-bmt^{m-1}}{(c + t^m)^2} \tag{2}$$

and, for a particular value of the derivative, such as $P'_T$, (i.e., the pressure decline rate at time T), the time at which that value occurs is stated by Eq. (3):

$$T = \left[\frac{-P'_T(c + T^m)^2}{bm}\right]^{\frac{1}{m-1}} \tag{3}$$

Using the computed values of "b", "c" and "m", an iterative technique can be used to solve Eq. (3) for the time at which a certain value of $P'_T$ occurs, and Eq. (1) can then be used to predict the associated pressure.

Within each computation cycle, the time at stabilization $t_s$ (e.g., when $P'(t_s)$=−3 psi/min) is computed from Eq. (3), using the coefficients from the current best fit of Eq. (1). The pressure at stabilization $P_s$ is computed from Eq. (1) using the computed values of "A", "b", "c", "m" and $t_s$. This is compared with previous $P_s$ forecasts and a test for convergence to a stable solution is applied. "Stable solution" here means the forecast or predicted pressure does not change appreciably as more data is added, whereupon the user/operator is confident that the solution correctly represents the pressure trend and can be used to interpret the current BOP test.

Various "tests for convergence to a 'stable solution'" may be used. In one embodiment, the convergence test requires a minimum of 60 consecutive $P_s$ predictions to be within 3 psi of one another. In one working situation, additional data was obtained about once every second of time. There are many possible tests with attendant trade-offs of solution time (i.e., elapsed shut-in time to obtain the first stable solution) and pressure forecasting accuracy. A range of tests was investigated, and the combination of sixty samples and 3 psi was found to be an appropriate criterion: the "(60, 3) criteria."

When a stable solution is obtained, the predicted value of $P_s$ is compared to the required test pressure $P_{req}$. In the simplest situation, if $P_s$ is greater than or equal to $P_{req}$, the test is declared "successful" (positive) and, given confidence in the interpretation, the test can be ended in order to proceed to the next test. If $P_s$ is less than $P_{req}$, the test is declared "unsuccessful" (negative) and, given confidence in the interpretation, the test can be "pumped up" or repeated. After stability is achieved, one or more additional tasks may be performed: a graphical display is created that depicts the modeled forecast pressure computations ahead of actual or measured pressure readings; a report is generated that logs testing times, forecast pressures, actual pressure, predicted final pressure, and required test pressure; etc. Other possibilities are readily suggested to those of ordinary skill in the art.

Digital BOP testing interpretations have been, and will for some time, continue to be compared with chart recorder results (see FIG. 1) where the chart method is presumed correct and the digital method may or may not concur. It may therefore be desirable to calibrate the digital method to the chart method to facilitate comparisons. The digital algorithm is therefore focused on predicting the pressure $P_s$ at which a test performed by the chart method is likely to be ended and interpreted (e.g., the shut-in pressure at which the pressure decline rate is −3 psi/min.).

Digital Algorithm Performance Study

The $P_s$ prediction accuracy of the digital BOP testing algorithm was quantified by applying it to a study group of 98 high pressure subsea BOP tests obtained from 17 fortnightly test suites, all conducted on the same floating drilling rig in the U.S. Gulf of Mexico. This group is significant in that all tests were held shut-in to pressure decline rates of −3 psi/min or less, thus enabling direct comparison of $P_s$ predicted and $P_s$ actual.

Figure 5:
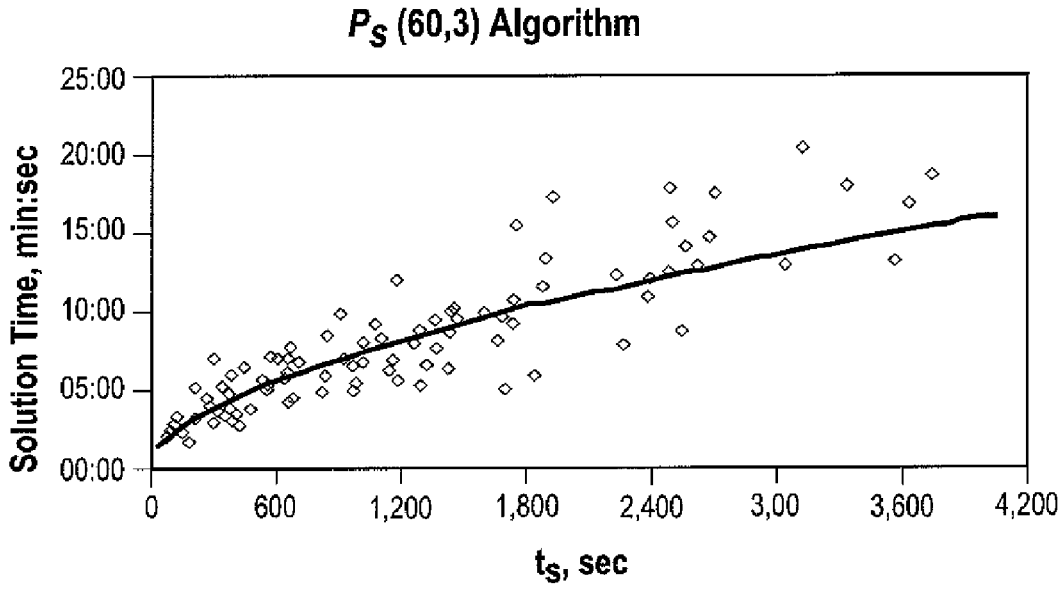
FIG. 5 illustrates Digital BOP Testing solution times varying in proportion to the value of $t_s$.

There is a positive relation between $t_s$ (elapsed shut-in time at which the pressure decline rate is predicted to be −3 psi/min) and digital BOP testing algorithm solution times (see FIG. 5). The average solution time in the 98-test study group was 07:37 minutes with a maximum of 20:29 and a minimum of 01:14.

Figure 6:
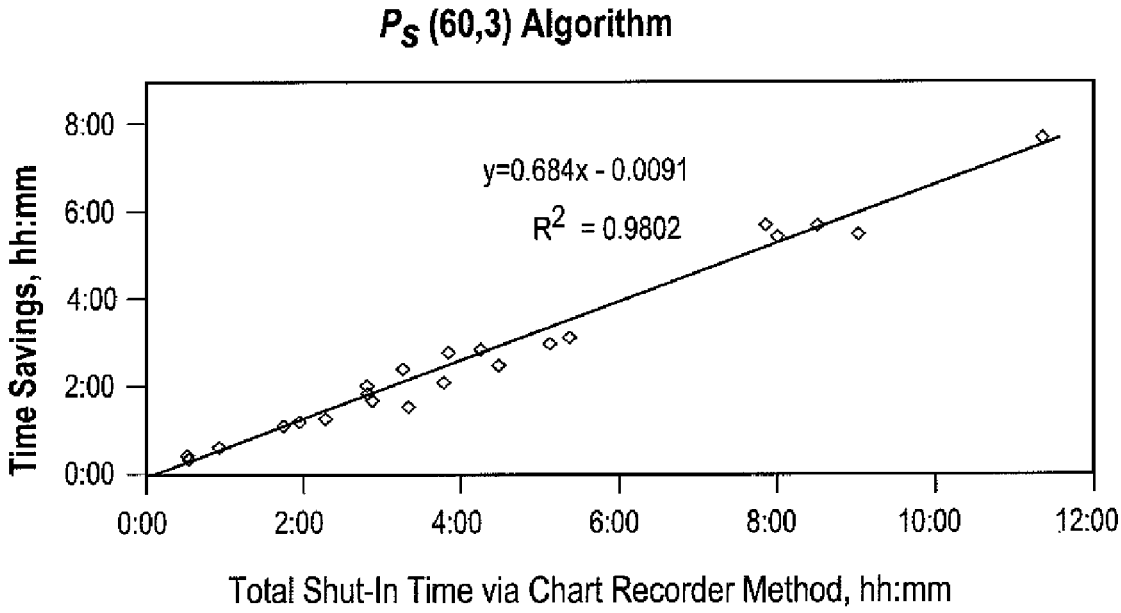
FIG. 6 illustrates Digital BOP Testing can reduce the required shut-in time by 68%.

The potential time savings via digital BOP testing for a given test series are a linear function of the total shut-in time required to complete the series by chart recorder method. Digital BOP testing should consistently reduce the required shut-in time of the chart recorder method by approximately 68% (see FIG. 6).

Figure 7:
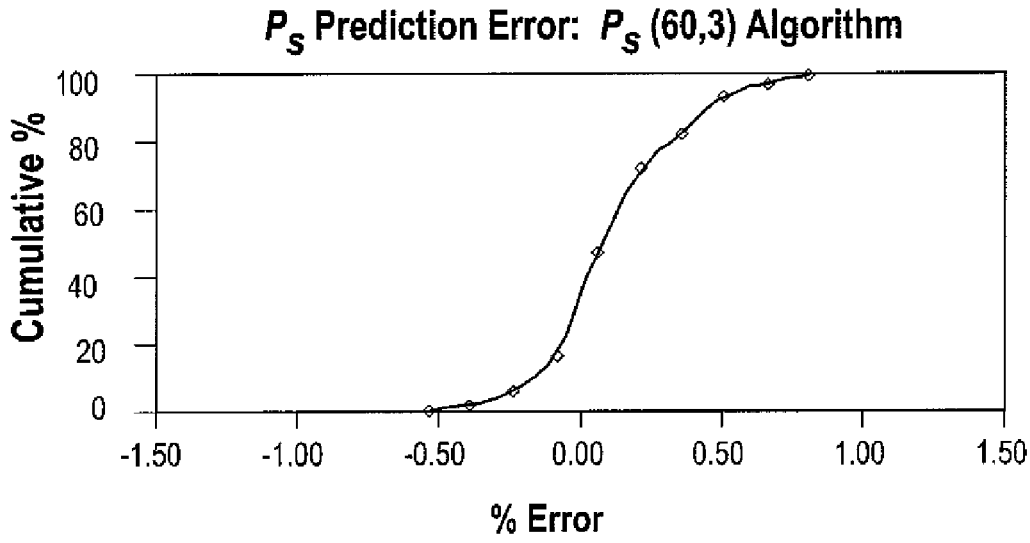
FIG. 7 shows the cumulative distribution of Ps prediction errors in the study group.

FIG. 7 shows the cumulative distribution of $P_s$ prediction errors in the study group. The error range is −0.53% to 0.81% with a mean of 0.11% and standard deviation of 0.24%. Hence, if a chart recorder test starts at 8,850 psi and the actual $P_s$ value is 8,020 psi, it is reasonable to conclude that the digital BOP testing forecast will be within the range 8,010 psi to 8,048 psi with the most likely value being 8,029 psi.

Figure 8:
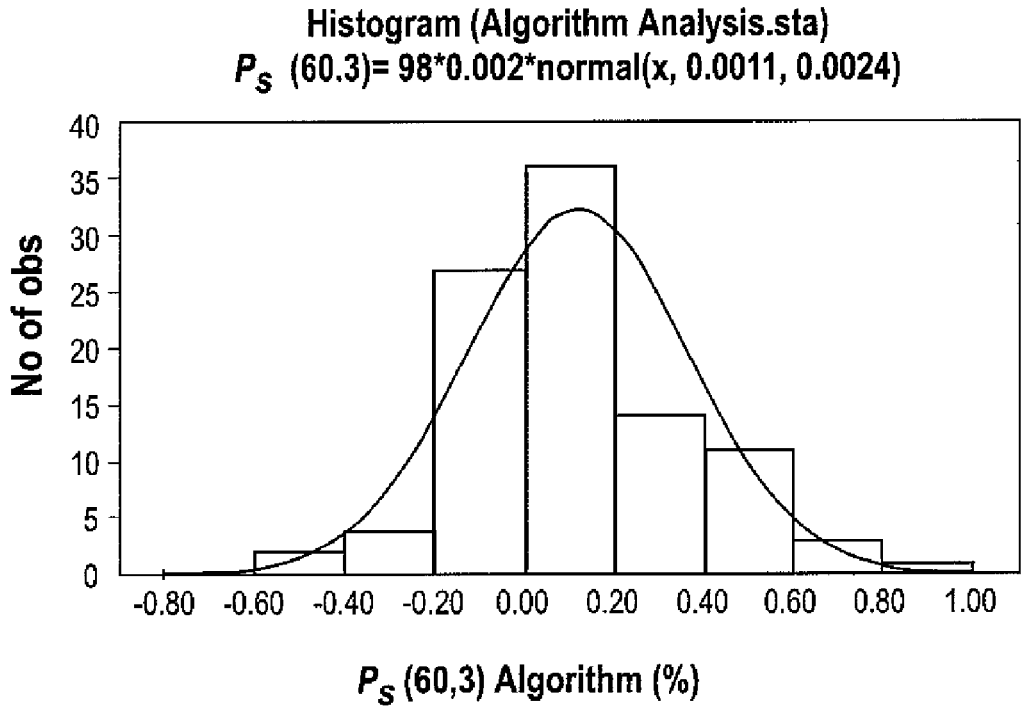
FIG. 8 shows the data of FIG. 7 in histogram format with a "bell curve" superimposed.

FIG. 8 shows the data of FIG. 7 in histogram format with a "bell curve" superimposed. This indicates an approximately normal distribution of error values. The digital BOP testing algorithm produces an approximately normal distribution of $P_s$ forecasting errors. Assuming the rules of normal distributions apply to these data, statistically significant conclusions can be drawn from an error analysis:

- The mean $P_s$ prediction error of a subset (the study group of 98 high-pressure sub-sea BOP tests held shut-in to pressure decline rates of −3 psi/min or less) of the total population (all subsea BOP tests of which the study group is representative) falls within the range 0.11%±0.05%, 95% of the time (or 19 times out of 20).
- The error term falls within the range −0.62% to 0.75% 99.5% of the time with 95% confidence.
- The upper bound error will be less than 0.69%, 199 times out of 200 (99.5% of the time).

The practical result of this error analysis is that:

- The digital BOP testing algorithm is highly accurate, on par with or better than measurement accuracies of the electronic pressure transducers and mechanical chart recorders typically in use on CUs where subsea BOP tests are interpreted.
- The condition for a test to be deemed "positive" (i.e., stated previously as $P_{s\ predicted} \geqq P_{req}$) can incorporate the 99.5% upper bound error, by implementing it in the digital BOP testing software as $P_s(1-\delta_{upper\ 95.5}) \geqq P_{req}$ where $\delta_{upper\ 95.5}=0.0069$. Those skilled in the art understand that the value 0.0069 can be adjusted to reflect additional knowledge of algorithms, performance and the desired safety factor(s).

Digital BOP Testing Software

Digital BOP testing is most conveniently implemented by software loaded on a laptop computer 50 with the intent of supporting the current workflow of subsea BOP testing. Although the software is therefore designed to be seen and used at CUs 12 by CU operators, those skilled in the art realize that the software may be used by other personnel at the drilling rig, and by personnel remotely located from the rig.

Figure 9A:
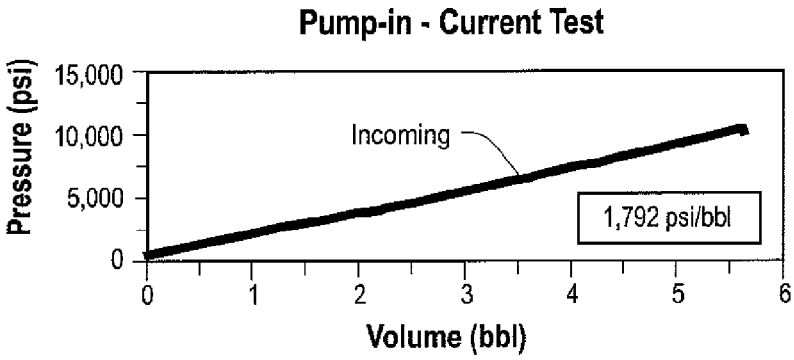
FIGS. 9A and 9B depict the displays seen during initiation of high pressure subsea BOP tests.
Figure 9B:
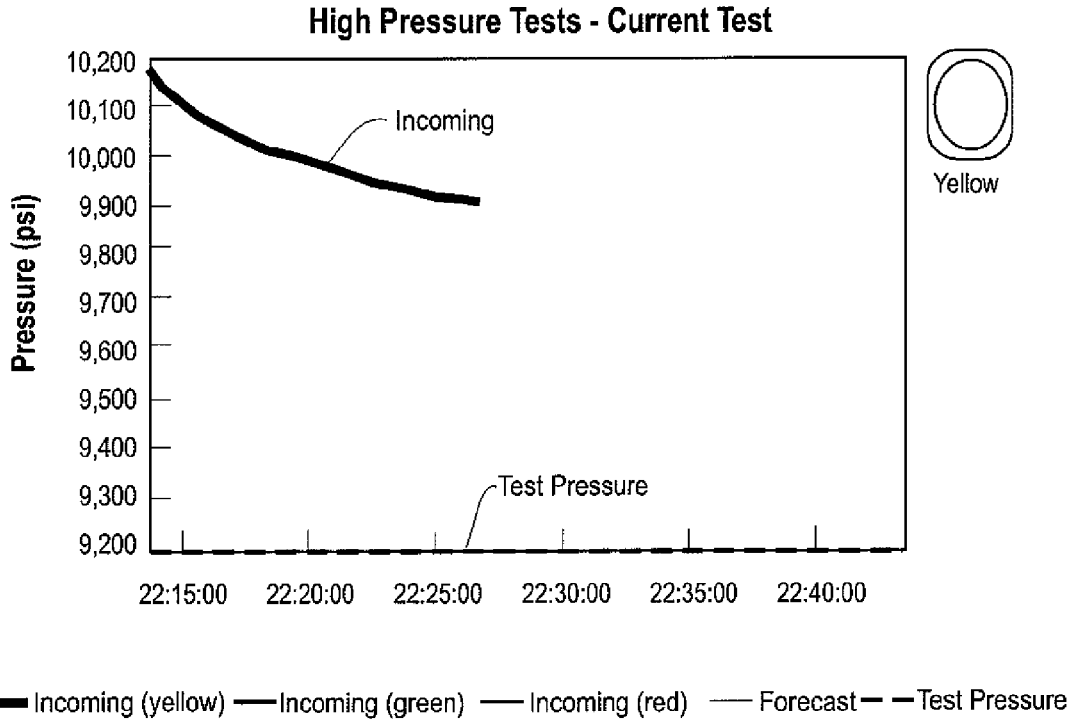

FIGS. 9A and 9B depict the displays seen during initiation of high pressure subsea BOP tests. Digital BOP testing software displays a pressure vs. volume graph during pressurization (FIG. 9A), and then the initial shut-in pressure test data are displayed while being analyzed (FIG. 9B). In FIG. 9B, the yellow line is actually a series of successive discrete pressure measurements, which because of the scale of the time axis, appears as a continuous line, A pump-in graph obtained during pressurization shows the linear relation of pressure vs. volume, computed in this example to be 1,792 psi/bbl. Once pumping ends, a graph of shut-in pressure vs. time is updated with each new pressure measurement taken by the PC. A distinctively colored light (here yellow for "noncommittal") is displayed on the PC while digital BOP testing software analyzes the data and seeks a stable pressure forecast.

A pressure forecast, shown in purple, is displayed after the first stable solution is obtained (see FIGS. 10A and 10B) and the test is interpreted as either positive or negative. The test is positive in this example so a distinct colored light (here green for "safe" or "positive") is displayed. The light would be red in the event of a negative test interpretation. The required test pressure is shown in red at the bottom of the graph. Pending regulatory approval of digital BOP testing, the intent is for a test to end after receipt of a conclusive interpretation. The test in this example was shut-in for 51 minutes additional time because it was interpreted by chart recorder method. This depicts how well the observed data overlay the pressure forecast. In addition, a graphical display (See FIG. 14 of published USA patent application 2005/0269079) may be presented to the user.

In particular, the familiar red, green, and yellow "traffic light" scheme was implemented to clearly identify the results of testing:

A "green" light was assigned to a test when:

1. $P_s$ predictions satisfy the (60,3) criterion, and
2. $P_s(1-\delta) \geqq P_{req}$ where $\delta=0.0069$, and
3. $(P_s-P_z)/P_s \leqq 0.125$.

The digital algorithm can obtain stable solutions during analysis of subsea BOP tests in less than 5 minutes of shut-in time. Preferably, digital BOP testing software should not display a green light until at least 5 minutes of shut-in time have elapsed. This is necessary to comply with the current MMS requirement of "must hold the required pressure for 5 minutes."

A "red" light was assigned to a test when:

1. $P_s$ predictions satisfy the (60,3) criterion and
2. $P_s(1-\delta) < P_{req}$ where $\delta=0.0069$, or
3. $(P_s-P_z)/P_s \geqq 0.125$.

If shut-in pressure $P_s$ falls below $P_{req}$ before a test is ended, a red light is lit.

The green light criteria was $(P_s-P_z)/P_s \leqq 0.125$ where:

1. $P_s$ is the "stable" pressure associated with prediction of the time $t_s$ when $P'_T=-3$ psi/min, and
2. $P_z$ is the pressure associated with prediction of the time $t_z$ when $P'_T=-1$ psi/min.

The purpose of examining the pressure forecast at times $t_s$ and $t_z$ was to discern if the modeled pressure decline trend extrapolated to a relatively high pressure (indicative of no leak), or a relatively low (possibly zero) pressure which would be indicative of a leak. The conditional value of 0.125 was empirically determined from a study of 145 high pressure subsea BOP tests to discern the range of normal vs. anomalous values of the quantity $(P_s-P_z)/P_s$. The $(P_s-P_z)/P_s \leqq 0.125$ criteria addresses improbable, but possible, instances of tests with very small leaks initiated at sufficiently high pressures to satisfy the $P_s(1-\delta) \geqq P_{req}$ requirement. This use of the digital BOP testing pressure forecast is meant to provide an appropriate safeguard, in addition to those already described, to assure digital BOP testing meets or exceeds the capability of the current chart recorder method to correctly interpret subsea BOP tests. Other safeguards may be employed for similar purposes. Once a reliable model of the pressure trend is obtained, numerous digital analyses may be performed to evaluate the information in greater detail.

Figure 10A:
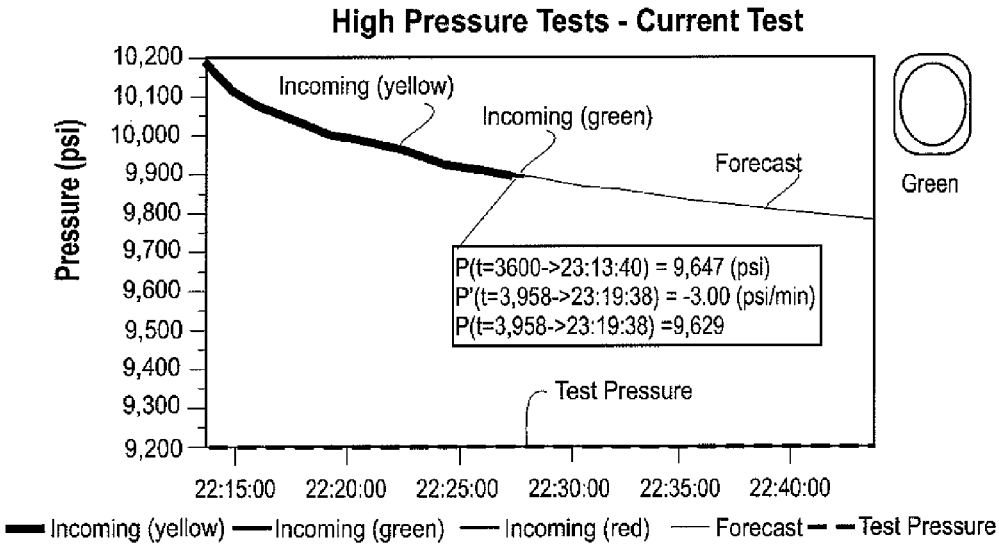
FIGS. 10A and 10B show a pressure forecast display when the first stable solution is obtained.
Figure 10B:
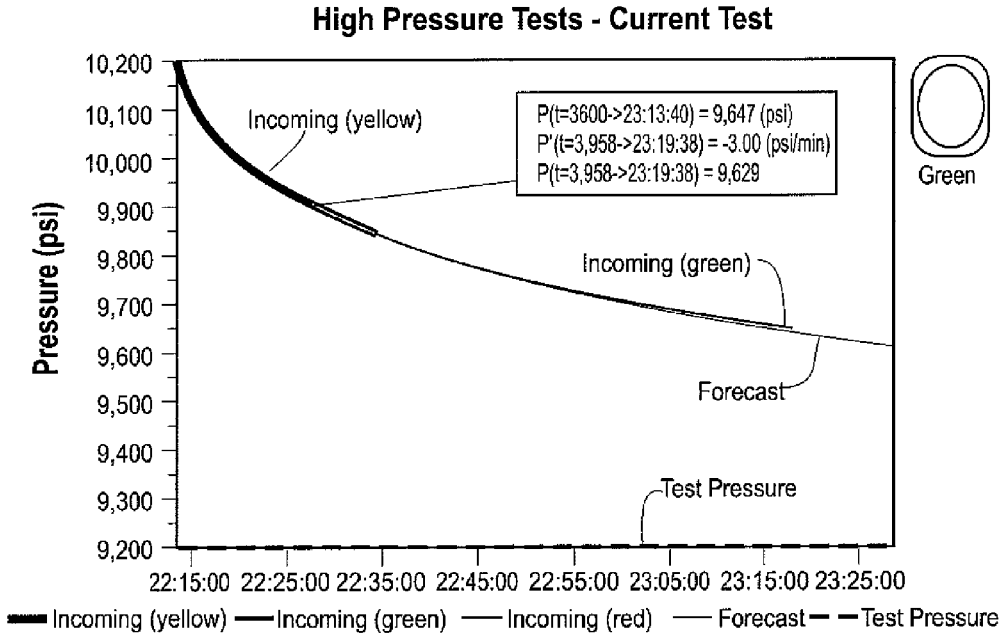
Figure 11A:
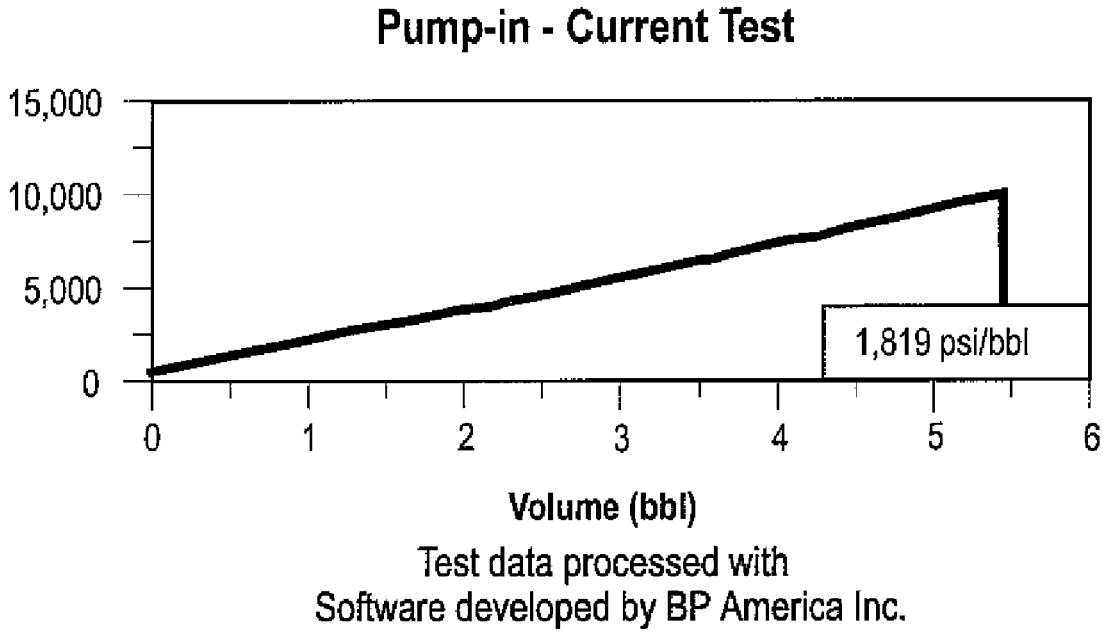
FIGS. 11A through 11D show a similar result from the subsea BOP test conducted subsequent to the example of FIG. 10.
Figure 11B:
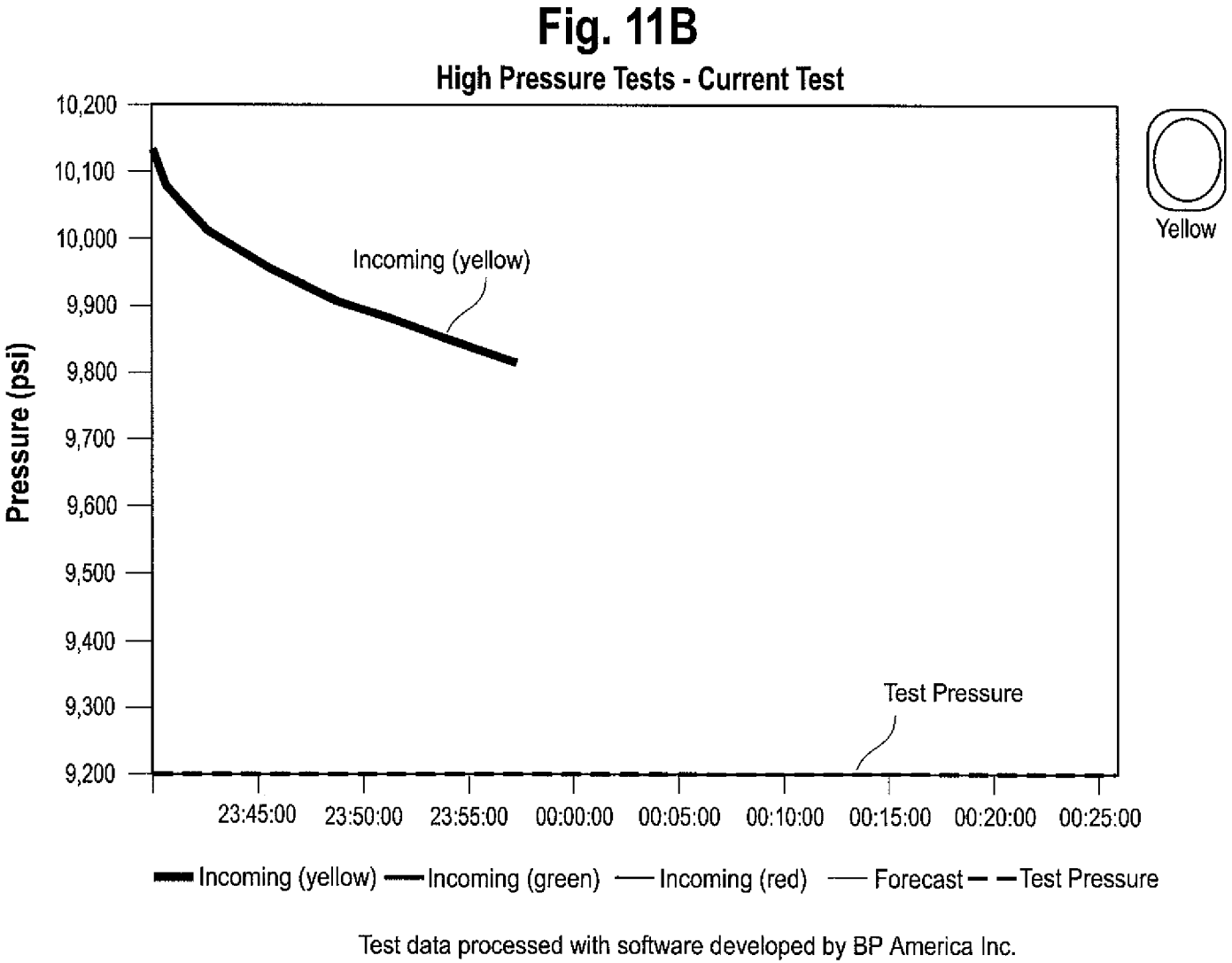
Figure 11C:
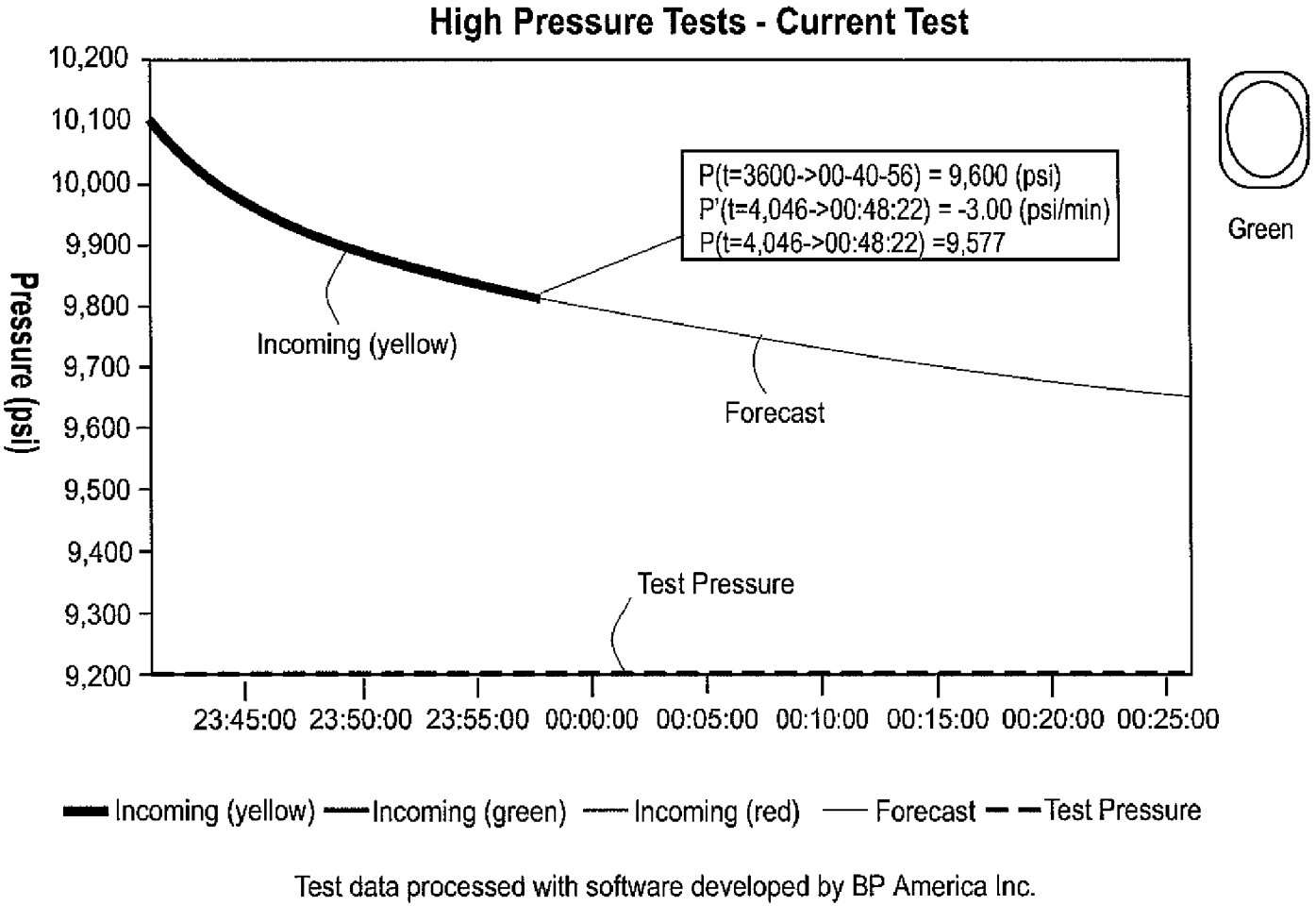
Figure 11D:
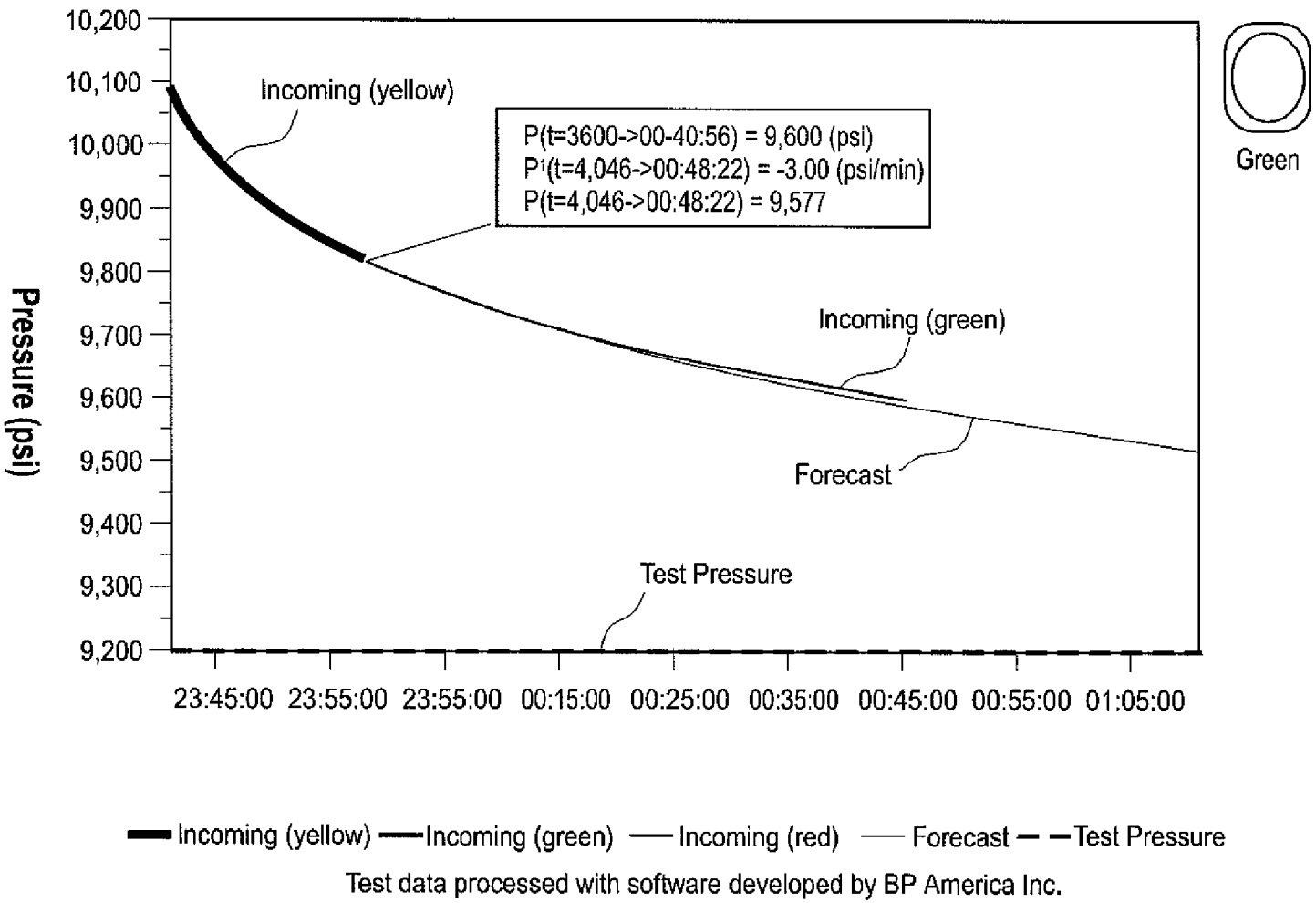

FIGS. 10A and 10B show digital BOP testing software results. A pressure forecast is displayed and the test data are interpreted once a stable solution is obtained (FIG. 10A). A stable solution was obtained 15.9 min post shut-in, and $P_{s\ predicted}$ was 9,629 psi occurring at clock time 23:19:38. The test continued to a pressure decline rate of −3 psi/min from which $P_{s\ actual}$ was 9,661 psi occurring at 23:13:12. The −32 psi difference between $P_{s\ predicted}$ and $P_{s\ actual}$ is a forecasting error of −0.33%. Digital BOP testing software correctly interpreted the test as positive, but did so 51 minutes ahead of the chart recorder result. In FIG. 10B the test remained shut-in following the initial pressure forecast, and additional pressure data is displayed to show the accuracy of the forecast. The Eq. (1) values of the pressure forecast are: A=8,906.5; b=2.887E+5; c=2.246E+2; and m=0.623.

FIGS. 11A through 11D show a similar result from the subsea BOP test conducted subsequent to the example of FIGS. 10A and 10B. The test was held shut-in for 65 minutes to a pressure decline rate of −3 psi/min. Digital BOP testing software obtained a stable solution 17.2 minutes post shut-in, and $P_s$ was predicted as 9,577 psi occurring at 00:48:22 hours. $P_{s\ actual}$ was recorded as 9,608 psi occurring at 00:42:01. $P_{s\ predicted}$ was 31 psi less than $P_{s\ actual}$ representing a −0.32% forecasting error. Digital BOP testing correctly interpreted the test as "positive" but did so 48 minutes in advance of the chart recorder result. $P_s$ was predicted with 99.7% accuracy 48 minutes ahead of the chart recorder result. The Eq. (1) values of the pressure forecast are: A=8,802.3; b=3.689E+5; c=2.804E+2; and m=0.635.

Table 1 displays results from a series of ten surface manifold tests held shut-in to pressure decline rates of −3 psi/min or less thus enabling quantification of $P_s$ prediction accuracies and potential time savings obtainable through use of digital BOP testing software. The average solution time was 6.9 minutes with a mean error of −0.08%±0.04% yielding a potential 50% reduction of the total shut-in time required by the chart recorder method of interpreting surface manifold tests.

TABLE 1

DWH_2006-05-11 SURFACE MANIFOLD TESTS
$P_s$ (3, 60) Algorithm Forecast

| Ps[psi] | error [psi] | error % | solution time | time savings |
|---|---|---|---|---|
| 7,702 | −1 | −0.01% | 0:04:52 | 0:01:19 |
| 7,656 | −6 | −0.08% | 0:07:11 | 0:04:56 |
| 7,631 | −3 | −0.04% | 0:06:54 | 0:06:14 |
| 5,142 | −6 | −0.11% | 0:05:32 | 0:08:09 |
| 5,157 | −7 | −0.13% | 0:05:42 | 0:06:52 |
| 5,195 | −5 | −0.09% | 0:05:26 | 0:08:41 |
| 5,179 | −6 | −0.12% | 0:06:09 | 0:07:36 |
| 7,553 | −6 | −0.09% | 0:15:13 | 0:14:24 |
| 6,542 | −6 | −0.10% | 0:06:45 | 0:08:45 |
| 7,702 | −2 | −0.03% | 0:04:56 | 0:02:13 |
| avg | −5 | −0.08% | 0:06:52 | 0:06:55 |
| max | −1 | −0.01% | 0:15:13 | 0:14:24 |
| min | −7 | −0.13% | 0:04:52 | 0:01:19 |
| std dev | 2.10 | 0.04% | 0:03:03 | 0:03:41 |
| | total shut-in time | | 2:17:49 | |
| | total time savings | | 1:09:09 | |

Figure 12:
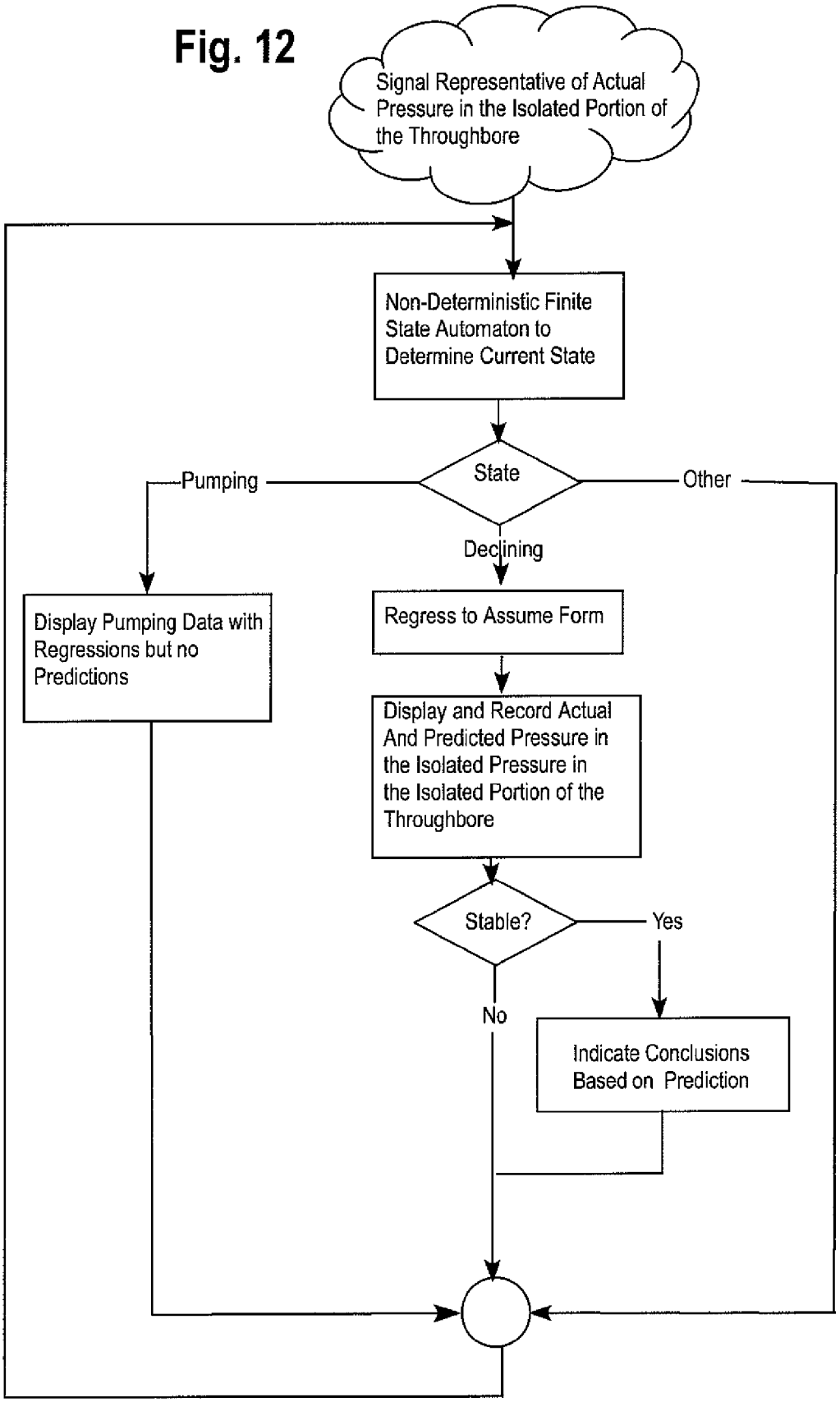
FIG. 12 is a block diagram depicting the process of the present invention.

FIG. 12 describes the operation of digital BOP testing software. The software code was initially written in C++ version 6.0 with the Microsoft Foundation Class Library (MFC) and in Visual Basic 6.0. Subsequent releases were written in C#. There are several ancillary programs in other languages (e.g. Mat Lab). Two programs implement the algorithm: Anatomize and Clouseau. Both rely on external dll files that only become memory resident during execution. Software development was initially performed on a Gateway Power Spec desktop computer. A Dell desktop PC was used during field testing (using an Intel dual-processor running at 3.2 G Hz). The operating system was Microsoft Windows XP. Data was sent to the PC after analog to digital conversion via an Ethernet connection.

Figure 14:
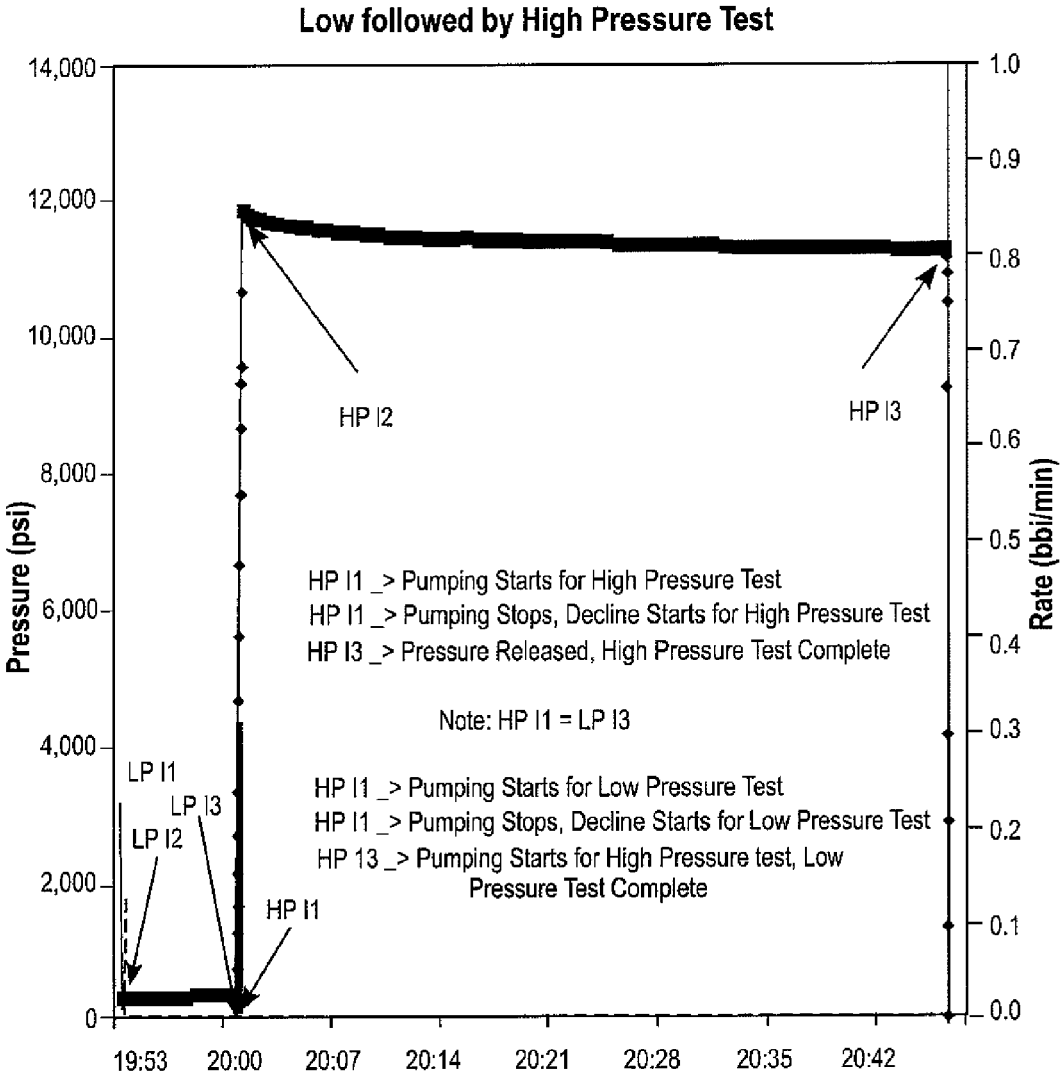
FIG. 14 illustrates the sequence of events depicted in FIG. 13.

FIG. 14 illustrates a BOP test and a set of "labeled tags" utilized in the automation of FIG. 12. The tags are defined in Table 2.

TABLE 2

| Tag | Description |
|---|---|
| To | Earliest time of test |
| I1 | Pumping start for test |
| I2 | Pumping stops for test |
| I3 | End of test |
| Te | Latest time of test |

These labeled tags assume a perfect test sequence like the one shown in FIG. 14. There will be instances where it may be impossible to identify some of the tags and there may be instances where the same tag occurs more than once. But the goal is to have a common language associated with a test sequence including metrics that can have values.

There can be any number of low or high-pressure event tag sets (i.e., sets of {I1, I2, I3}). Determination of the various tags is accomplished using a Non-Deterministic Finite-State Automaton (NFA) visualized in FIG. 13. NFA forms the basis of the event recognition approach. Although it may mature with time, this NFA has performed quite adequately for testing described herein. This NFA can also be used for real-time acquisition (such as occurs in Anatomize software).

Figure 13:
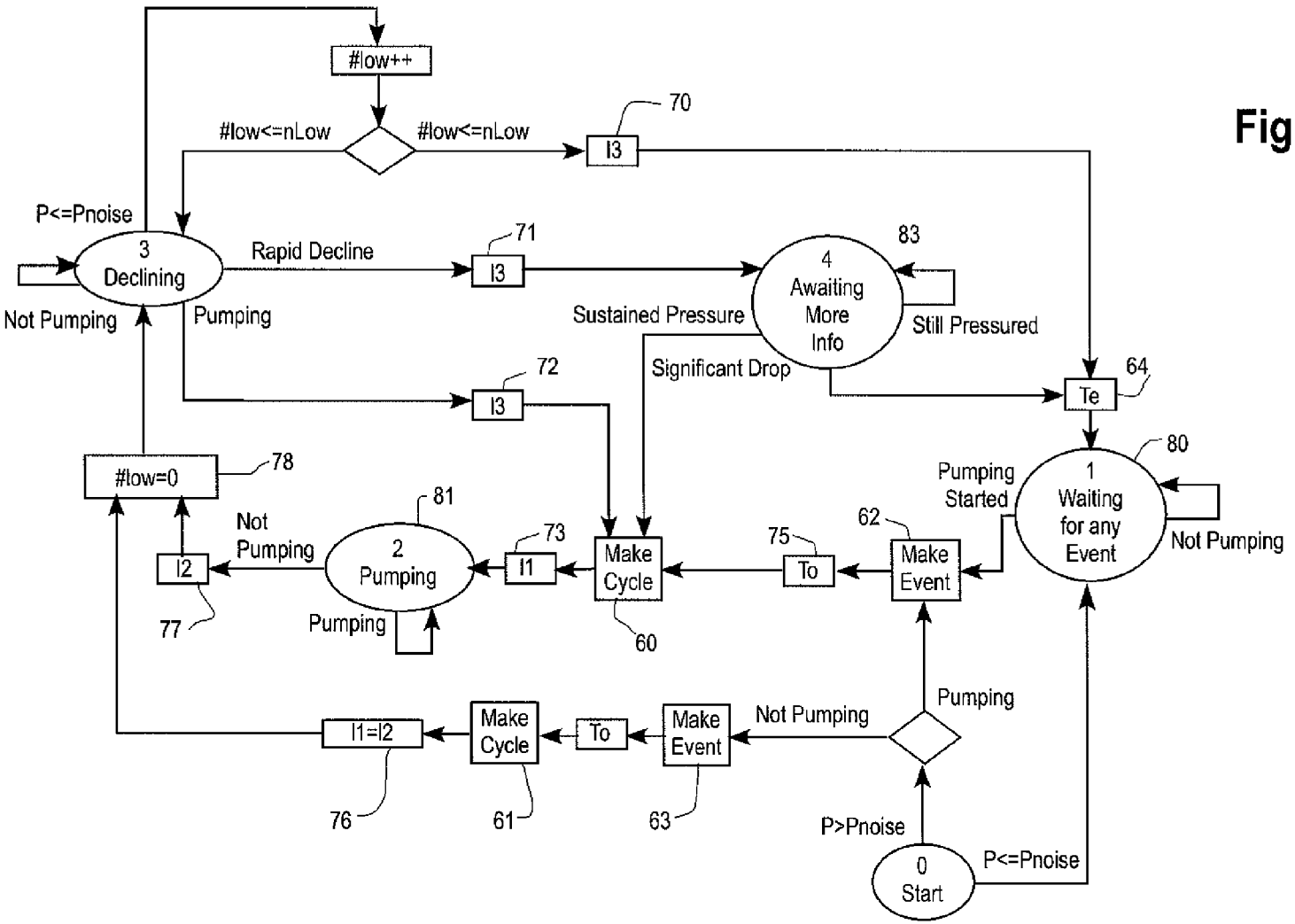
FIG. 13 is an annotated finite-state automaton performed by the computer.

Referring to FIG. 13, $P_{noise}$ is a pressure that is assumed to be just at the noise level (e.g., 100 psi). Pressures below this value are presumed to be zero; all pressure reports below $P_{noise}$ are assumed to represent an un-pressurized cavity. This is intended to accommodate inherent noise in acquired pressure data. "nLow" is a count of the number of samples that fall below the presumed noise level $P_{noise}$ (i.e., the isolated portion of the throughbore of the BOP is assumed to be unpressured). This accommodates noise in the pressure data where a few pressure reports might be unrealistically low.

In FIG. 13 there are four boxes: two cycle boxes 60 and 61 and two event boxes 62 and 63. In all four occurrences, there are exactly two lines of text:

"Make" is always on the first line, and either

"Cycle" (boxes 60 and 61), or "Event" (boxes 62 and 63) on the second line. In the diagram, "Make" implies the programmatic creation of an instance of the specified object. In C# (and other object-oriented languages), objects are blocks of memory that contain unique variable storage and references to actions (methods) that the object can perform. Thus, "Make Event" implies that a new Event object is created in memory and made accessible for data storage and actions (invocation of the objects methods). Objects can (and in this case do) persist for the life of the program.

Cycle and Event are concepts in the real world and objects in code. An Event is pictorially represented as of one of the "towers" appearing in FIG. 13; a numeric annotation indicating the Event number appears above the towers that have significant time duration. Events are an ordered set: {1, 2, 3 . . . }. Conceptually, an Event is when something is being pressure tested; regardless of the outcome of the test. Generally (but not always) an Event consists of a low-pressure test followed by a high-pressure test (See FIG. 14). The high-pressure test portion immediately follows the low-pressure portion with no return to zero pressure.

Programmatically, an Event is implemented as a class (and thus an object). An Event object is created when no Event is active and the pressure rises above threshold value. An Event terminates when the logic described in FIG. 13 reaches box 64 with "Te" inside. Each object Event contains the Event number, Test number, starting and ending index (i.e., To and Te) in the general data pool, the highest pressure reached during the Event, and a handle on the general data pool where To and Te apply. An Event includes an ordered collection of Cycle objects. Event objects: know how to save and harvest themselves to and from a storage file, can describe themselves in three formats, and can deliver the best known high-pressure, low-pressure and pumping cycle. Each of the three formats is an expression intended for List boxes. Two of the formats are for information-only purposes; that is, a self-description designed for human consumption. The third format is designed to allow the List in which they are presented to act as selection List; for example, Events could present themselves by name, start and end times with the expectation that a user will subsequently select them. This is similar to the list of recent files presented by commonly used Microsoft Word software under the File toolbar. An ordered collection of Events exists at the highest level of Anatomize.

Any number of Cycles can exist as "children" of an Event. A Cycle encompasses consecutive data reports within an Event that are pumping followed by not-pumping reports. In the simplest case, an Event could consist of a single Cycle where pressure was being built during pumping followed by reports where pumping had stopped and the decline portion of the test was conducted.

In most real-world cases, several Cycle objects are created as alternating pumping and decline operations occur. A simple two-step pressure test (depicted in FIG. 14) consists of an initial pumping phase to achieve a low-pressure test level followed by a non-pumping decline portion (Cycle 1). After an assurance that the low-pressure test was successful, another pumping phase is used to raise the pressure to the level of a high-pressure test followed by the high-pressure decline phase (Cycle 2). Real-world operations may see the creation of a dozen or more Cycles as the pump operator alternates between pumping and decline phases.

A Cycle is implemented as a class and contains a variety of data including the test pressure deemed appropriate to the Cycle (i.e., determined at run time), the highest pressure achieved during the Cycle, a variety of algorithm-specific parameters (e.g. dP/dt for First Stability), initial light parameters and vectors containing data analysis performed during the Cycle including formula parameters (i.e., A, b, c and m in Equation 1).

A Cycle object knows how to save and harvest itself to and from a storage file. It can deliver information about the analyses performed (e.g., the time when the first derivative of the analysis was equal to a particular value). A Cycle can describe itself in several formats. It can determine if its data is a bounded set (used here to mean if all data subsequent to First Light is bounded by a Validity Algorithm, for example). Cycle objects are also used in separate threads to create the data analysis, that is, the regression of a collection of contiguous data reports contained in the general data pool and a determination of the significance of the regression: the Yellow, Red and Green indicator lights.

In the drawing, boxes 70 through 78 denote the most significant program memory of a state change. For example, leaving State 2 Pumping always results in "I2" being set (which is recorded in a Cycle) and #low 78 being reset (set to zero) which is done outside of either an Event or a Cycle. A box 74 and 75 with "To" indicates that the new Event just created is tagged with the index into the general data pool where the Event begins. A box 64 with "Te" indicates that an Event ended and was tagged with the last index into the general data pool where the last applicable data report occurred for that Event.

In FIG. 13, the large circles 80, 81, 82, and 83 represent "States" (i.e., the situation the program finds itself in). For example, the first state 80 "1 Waiting for any Event" is where the program assumes no Event is current. and it is looking at each new data report with the expectation that an Event will start (or be noticed). The FSA diagram shows that this State can only be "exited" when pumping starts, and can be "entered" either initially (from "0 Start" if the pressure is low), or after an Event has been closed (i.e., box 64).

Processing Discussion: Practical Considerations

In theory there should be no need to perform data smoothing. It is only due to induced electronic noise (usually resulting from a lack of shielding) and low precision sensors that data smoothing becomes necessary. Under the right circumstances data smoothing will not be required. Others are working to create just such an environment in the real world.

Also, when the initial analog-to-digital conversion is made, there is a possibility that spurious electrical signals are introduced into the converter through radiation (e.g., sparking motors, transmitting radios, portable phones, etc.) and through hard connections (variations/noise in the power supply and inherent component noise).

In addition, noise may be introduced in the analog signal from the BOP and CU pressure sensors. Most pressure transducers 52 have a precision of only a few psi or perhaps tens of psi. Thus, under perfect conditions, the pressure transducer will have some characteristic noise (it is usually published in the transducer specifications). It is possible to get very precise transducers, but they are expensive. Historically there has not been a need for the kind of precision currently sought, and the field is replete with the less expensive transducers.

"Predictive wag" may result in a failure of the overall algorithm to report a prediction to the end user. Internally, the algorithm (with very few exceptions) makes a prediction with every new data point, but the predictions must be self-consistent before a prediction is reported to the end user. Part of the overall methodology is that the predictive wag is small before the automation is considered sufficiently steady to report a prediction to the end user. This criterion is based on the assumption that if each consecutive prediction is being made on a single population created from a representative data set, the predictions must all result in the same value.

For example, assume that, for given values of {A, b, c, m}, $$P(t) = A + \frac{b}{c + t^m}$$

is created for integer values of $3<t<N$ (where N is some very large number). A perfect regression of the generated dataset for any number of data points (say k, where $k \geqq 4$) (i.e., $\{A_k, b_k, c_k, m_k\}$) should reproduce the original set of coefficients. If the thus created coefficient sets $\{A_k, b_k, c_k, m_k\}$ vary, there is some inherent problem. Experiments performing regressions to artificial datasets have demonstrated the basic algorithmic approach: the same set of coefficients {A, b, c, m} are created for any number of data points (within numerical accuracy). A set of created coefficients $\{A_k, b_k, c_k, m_k\}$ is essentially the same as a prediction. A prediction is just $$A + \frac{b}{c + T^m}$$

where T is the time of the prediction. There are two major reasons the predictions would not be consistent (i.e., predictive wag is intolerably high):

1. If the real-world population is not being developed from a physical process that can be described with the assumed form, then each addition to the population will result in a new predicted value. One interesting example of this is a linear decline with time $P(t)=\alpha+\beta t$. This form closely resembles a leak in the system. That is, there will be predictive wag in the case of a leak, and the internally-generated predictions will not be steady; they are "wagging" (in this case, monotonically, but the effect is the same: a non-steady prediction).
2. If there is a large amount of noise in the incoming data, particularly at early times, the internally-generated predictions will have a greater swing. The predictive wag will simply be a reflection of the noise in the data. This indication of noise could be sufficiently large for the overall algorithm to fail in providing a prediction to the end user; the noise would be large to mask the underlying data negating a legitimate prediction.

CONCLUSIONS

1. Individual subsea BOP tests can require upwards of an hour for pressures to stabilize acceptably when interpreted by chart recorder method.
2. In a 98-test study, digital analysis correctly interpreted all tests in an average solution time of 07:37 with a maximum of 20:29 and a minimum of 01:14 minutes.
3. In the same 98-test study, the digital pressure prediction error range was −0.53% to 0.81% with a mean of 0.11% and standard deviation of 0.24%.
4. Digital subsea BOP test interpretation can consistently reduce the required shut-in time of the as-practiced chart recorder method by approximately 68%.
5. Digital BOP testing software will perform similarly well when applied to high pressure surface manifold tests.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape and arrangement of components.

For example, during development, a number of alternative algorithm forms were tried with mixed results:

$$A+De^{Bt}$$

$$A+Be^{nt}+Ce^{mt}$$

$$A+(D/(B+Ct^{m}))$$

$$A+(D/(B+Ce^{mt}))$$

$$A+Be^{nt}+C\exp(mt+lt^{2})$$

$$A+(De^{nt}/(B+Ct^{m}))$$

$$A+De^{nt}+G/(B+Ct^{m})$$

where "e" or "exp" is approximately 2.71828183 and is the base of the natural logarithm, A, B, C, D, E, G, l, m and n are constants; and t is time.

Of all the forms tested, $$A+\frac{b}{c+t^{m}}$$

seemed to be the best. It is a good form and has proven effective in all known cases. Desirable features of a predictive algorithm are a reasonably good fit to the data, and a generally accurate depiction of the pressure change over time due to heat transfer. Undesirable characteristics are an algorithm that over-predicts pressure, has negative pressure predictions, and/or has increasing pressure predictions. Preferably the algorithm is not more computationally complex than is necessary to achieve the desired accuracy.

While this methodology is most applicable for synthetic and oil-based mud systems, it is applicable for all fluid systems. Moreover, equivalent elements may be substituted for those illustrated and described. For example, a specialized hand held computer (e.g., pocket PC, PDA or smart cell phone) may be used instead of a general purpose PC or laptop. Also, certain features of the invention may be used independently of other features of the invention. For example, the concept of the invention may not be limited to submerged BOPs or deep water drilling; shelf and land-based BOPs testing might also be affected. Since digital high pressure surface manifold testing and surface manifold testing are often required along with subsea BOP testing, there is a safety benefit to reduced personnel exposure to pressurized lines, a work benefit to completing tasks more efficiently and, a reliability benefit to objectively interpreting each test. Those skilled in the art should also understand that while the BOP Illustrated herein is representative of the general situation, there are other configurations. Most commonly, the drill pipe forms part of the pressure vessel to the extent that pressure is applied from the Cementing Unit via the kill and/or choke lines to its exterior over an isolated length inside the BOP stack, but pressure inside the drill pipe remains strictly hydrostatic. A less common configuration (but one used on one drillship from which field data is cited herein) dispenses with the test plug and instead uses a "test ram" a/k/a "Subsea Stack Test Valve (SSTV)" (see Judge, Robert "Minimizing the Cost of Required BOP Testing A Case Study", IADC European Well Control Conference, 4-5 Apr. 2006, Amsterdam). The test ram or SSTV is basically a lowermost pipe ram in the BOP stack with sealing elements inverted to hold pressure from above rather than below. The test ram forms the lower barrier of the test cavity in lieu of the test plug otherwise seated in the wellhead.

Thus, it will be appreciated that various modifications, alternatives, variations and changes may be made without departing from the spirit and scope of the invention as defined in the appended claims. It is, of course, intended to cover by the appended claims all such modifications involved within the scope of the claims.

We claim:

1. A method for testing a system comprising: a blowout preventer (BOP) having an upper end and a wellhead end, having a throughbore between the ends, and at least one means for closing the throughbore against a tubular located therein; a cementing unit (CU) for providing pressurized fluid; and piping for connecting the output of the CU to the BOP and into the throughbore of the BOP, the method comprising the steps of:

a) shutting the closing means in the BOP against the exterior of said tubular;

b) using the CU and the piping to increase the pressure in a portion of the throughbore around the tubular and against the closing means to a predetermined shut-in pressure;

c) selecting a predetermined regression model having a plurality of constant but undetermined coefficients, and expressing the pressure in said portion of the throughbore as a function of time;

d) using a signal that is representative of the pressure in said defined portion of the throughbore over successive time points and solving for the value of said coefficients of said regression model;

e) using said coefficients from step (d) and said regression model of step (c) to forecast the time when the rate of pressure change in said portion of the throughbore approximates a predetermined rate of pressure change;

f) using said coefficients from step (d), said regression model of step (c), and said time of step (e) to forecast the pressure in said portion of the throughbore;

g) repeating steps (d) through (f) until successive forecasts of said pressure in said portion of the throughbore stabilize relative to a predetermined convergence test; and h) producing a visual indication when said successive forecasts stabilize.

2. A method for testing a system comprising: a blowout preventer (BOP) having an upper end and a wellhead end, having a throughbore between the ends, and at least one means for closing the throughbore against a tubular located therein; a cementing unit (CU) for providing pressurized fluid; and piping for connecting the output of the CU to the BOP and into the throughbore of the BOP the method comprising the steps of:

a) shutting the closing means in the BOP against the exterior of said tubular;

b) using the CU and the piping to increase the pressure in a portion of the throuhbore around the tubular and against the closing means to a predetermined shut-in pressure;

c) selecting a predetermined regression model having a plurality of constant but undetermined coefficients, and expressing the pressure in said portion of the throughbore as a function of time, wherein said predetermined regression model is of the form $1/(c+t^m)$ where c and "m" are constants, and "t" is time;

d) using a signal that is representative of the pressure in said defined portion of the throughbore over successive time points and solving for the value of said coefficients of said regression model;

e) using said coefficients from step (d), said regression model of step (c) to forecast the time when the rate of pressure change in said portion of the throughbore approximates a predetermined rate of pressure change;

f) using said coefficients from step (d), said regression model of step (c), and said time of step (e) to forecast the pressure in said portion of the throughbore;

g) repeating steps (d) through (f) until successive forecasts of said pressure in said portion of the throughbore stabilize relative to a predetermined convergence test; and h) producing a visual indication when said successive forecasts stabilize.

3. The method of claim 2, wherein said predetermined convergence test of step (g) comprises N successive forecasts of said pressure in said portion of the throughbore, and wherein said successive forecasts are within a predetermined pressure difference Dp.

4. The method of claim 2, further including the steps of:

i) periodically recording the actual/measured pressure in said portion of the throughbore by using said signal from step (d); and j) periodically recording the pressure in said portion of the throughbore by using said coefficients from step (d) and said regression model of step (c).

5. The method of claim 2, where in step (g) steps (d) through (f) are repeated until said successive forecasts of pressure are not greater than a predetermined pressure "D" over a predetermined interval of time "T"; and further including the step of producing a distinct visual indication at least during the duration of time "T" and as long as said successive forecasts of pressure are greater than said predetermined pressure "D".

6. The method of claim 2, where at least steps (d) and (e) are performed using a non-deterministic finite state automaton comprising a digital computer.

7. The method of claim 2, where step (d) is performed by iteration.

8. The method of claim 2, where in step (c) said predetermined regression model is of the form $A+(b/(c+t^m))$ where A and b are constants.

9. The method of claim 2, further including the steps of:

i) displaying overtime the actual/measured pressure in said portion of the throughbore by using said signal from step (d); and j) displaying the pressure in said portion of the throughbore by using said coefficients from step (d) and said regression model of step (c).

10. In process for testing a BOP having a throughbore between its ends, and at least one device/annular for closing a tubular member within the throughbore, a pressurization unit connected to the throughbore of the BOP, and a means for producing a signal that is representative of pressure within a section of the throughbore, the testing process comprising the steps of:

a) closing the device/annular in the BOP to seal one end of the throughbore around the tubular member; b) using the pressurization unit to increase the pressure in the section to a pre-determined level;

c) using a predetermined algorithm, having at least "N" constants (a1, a2, . . . aN) for forecasting the pressure in the section of the throughbore as a function of time pet);

d) recording the actual/observed pressure in the section of the throughbore and the associated time;

e) using said actual/observed pressure and time values from step (d) to determine the value of said "N" constants (a1, a2, . . . aN);

f) using said "N" constants (a1, a2, . . . aN) from step (e) and said algorithm of step (c) to predict/forecast the time "Tf" when the pressure in the section of the throughbore will stabilize relative to a first pre-determined pressure decline rate, and to predict/forecast the pressure "Pf" at such time;

g) repeating steps (c) through (f) until successive values of said forecast pressure are within a predetermined pressure differential "Dp" over a predetermined interval of time "T"; and h) producing a first visual indication after said differential in pressure is maintained over said predetermined time interval "T".

11. In a process for testing a BOP having a throuhbore between its ends, and at least one device/annular for closing a tubular member within the throughbore, a pressurization unit connected to the throughbore of the BOP, and a means for producing a signal that is representative of pressure within a section of the throughbore, a testing process comprising the steps of:

a) closing the device/annular in the BOP to seal one end of the throughbore around the tubular member; b) using the pressurization unit to increase the pressure in the section to a pre-determined level;

c) using a predetermined algorithm, having at least "N" constants (a1, a2, . . . aN) for forecasting the pressure in the section of the throughbore as a function of time p(t);

d) recording the actual/observed pressure in the section of the throuhbore and the associated time;

e) using said actual/observed pressure and time values from step (d) to determine the value of said "N" constants (a1, a2, . . . aN)

f) using said "N" constants (a1, a2, . . . aN) from step (e) and said algorithm of step (c) to predict/forecast the time "Tf" when the pressure in the section of the throughbore will stabilize relative to a first pre-determined pressure decline rate, and to predict/forecast the pressure "Pf" at such time;

g) repeating steps (c) through (f) until successive values of said forecast pressure are within a predetermined pressure differential "Df" over a predetermined interval of time "T"; and h) producing a first visual indication after said differential in pressure is maintained over said predetermined time interval "T" and Pt/Pf is less than or equal to a predetermined fraction "F" where "Pt" is the pressure of step (b), and "F" represents a forecasting error of a predetermined probability distribution.

12. The process of claim 11, further including the step of displaying actual/measured pressure in the section of the throughbore as a function of time.

13. The process of claim 11, where said visual indication of step (h) is on the display of a portable computer, and said visual indication is an icon in the form of a traffic light.

14. The process of claim 11, further including step of producing a second visual indication until said pressure differential is less than Dp over said predetermined interval of time "T".

15. The process of claim 11, further including the steps of:

i) continuing to perform steps (c), (d) and (e);

j) using said "N" constants (a1, a2, . . . aN)) from step (e) and said algorithm of step (c) to predict/forecast the time "Tz" when the pressure in the section of the throughbore will stabilize relative to a second pre-determined pressure decline rate that is less than said first pre-determined pressure decline rate, and to predict/forecast the pressure "Pz" at such time; and k) producing a second visual indication if (Pf−Pz) is not greater than the product of Pf and "ϵ" where "ϵ" is less than one.

16. The process of claim 15, wherein said first visual indication of step (h) is colored red, and said second visual indication of step (k) is colored green.

17. The process of claim 15, wherein "ϵ" is empirically determined from testing a large sample of BOPs.

18. In a method of testing a BOP having a throughbore between its upper and lower ends and means for isolating a portion of the throughbore, a pressurization unit for applying pressurized fluid to the isolated portion of the throughbore of the BOP to a predetermined test pressure "Pt", and means for producing a signal that is representative of the actual pressure within the isolated portion of the throughbore, the testing process comprising the steps of:

a) using the signal that is representative of the actual pressure in the isolated portion of the throughbore over successive time points and a pre-determined non-deterministic finite state automaton to predict the successive pressures "Ps" in the isolated portion of the throughbore relative to a first pre-determined pressure decline rate, said automaton comprising a predetermined pressure forecasting algorithm;

b) providing a first visual indication when said successive predicted pressures stabilize relative to a predetermined differential "D" and a predetermined number of predicted pressures;

c) repeating steps (a) and (b) if the product of Ps and F is less than Pt where "F" is a predetermined fraction that is a statistically derived estimate of the upper bound error of said pressure forecasting algorithm, whereby a safety margin is introduced to minimize the occurrence of false positive test interpretations; and d) providing a second visual indication whether product of Ps and F is at least equal to Pt.

19. The method of claim 18, wherein said pre-determined non-deterministic finite state automaton predicts the successive pressures "Pz" in the isolated portion of the throughbore relative to a second pre-determined pressure decline rate; and wherein said second visual indication is further conditioned on (Ps−Pz) being less than the product of Ps and "E" where "E" is a fraction representative of relatively small leaks.

20. The method of claim 18, wherein the signal that is representative of the actual pressure within the isolated portion of the throughbore comprises electronic noise, and said non-deterministic finite state automaton comprises a digital computer that is programmed to smooth said signal that is representative of the pressure within the isolated portion of the throughbore and thereby reduce predictive wag.

21. The method of claim 18, wherein said non-deterministic finite state automaton comprises a digital computer that is programmed to:

(i) regress said signal that is representative of the pressure within the isolated portion of the throughbore to $$P(t) = A + \frac{b}{c + t^m};$$

(ii) compute successive sets of coefficients $\{A_{i+1}, b_{i+1}, c_{i+1}, m_{i+1}\}$;

(iii) compute the pressure decline rate of P(t);

(iv) compute the time when said first pre-determined pressure decline rate is achieved; and (v) compute the pressure in the isolated portion of the throughbore at said time of step (iv).

22. Apparatus for testing a BOP having a throughbore between its upper and lower ends and means for isolating a portion of the throughbore, and having means for producing a signal that is representative of the pressure within the isolated portion of the throughbore, comprising:

a) a digital computer that receives the signal that is representative of the current pressure within the isolated portion of the throughbore and that is programmed to:

(i) regress the signal to $A+b/c+t^m$; where A, b, c, and m are coefficients and "t" is time;

(ii) compute successive sets of coefficients $\{A_{i+1}, b_{i+1}, c_{i+1}, m_{i+1}\}$ from successive signals representative of the current pressure within the isolated portion of the throughbore over time;

(iii) compute the rate of change of said representative signals;

(iv) compute successive times when said rate of change is achieved;

(v) compute successive pressures for the times of step (iv); and (vi) signal when said successive pressure computations of step (v) become stable.

23. The apparatus of claim 22, where in step (vi) stability is achieved when said successive pressures for the times of step (iv) are at least less than a predetermined difference "D" over a predetermined interval of time "T".

24. The apparatus of claim 22, wherein pressure is applied to the isolated portion of the throughbore by a cementing unit having means for producing at least one signal representative of pumping rate, volume pumped and pump pressure; and wherein at least said one signal is used by said computer to begin regression.

* * * * *

UNITED STATES PATENT AND TRADEMARK OFFICE

CERTIFICATE OF CORRECTION

PATENT NO. : 7,706,980 B2
APPLICATION NO. : 11/931862
DATED : April 27, 2010
INVENTOR(S) : Warren J. Winters et al.

It is certified that error appears in the above-identified patent and that said Letters Patent is hereby corrected as shown below:

On the Title Page, Item (54) & Column 1, lines 1-2 in the title, "BLOWOUT PREVENTER TESTING SYSTEM AND METHOD" should read -- IMPROVED BLOWOUT PREVENTER TESTING SYSTEM AND METHOD --.

Column 3, line 48, the phrase "and "ϵ" where "ϵ" is" should read -- and "ε" where "ε" is --.

Column 7, line 53, "line," should read -- line. --.

Column 8, line 27, the formula "(Ps – Pz)/Ps≧0.125" should read -- (Ps – Pz)/Ps > 0.125 --.

Column 12, line 1, "current." should read -- current, --.

Column 16, line 18, "overtime" should read -- over time --.

Column 16, line 24, "In process" should read -- In a process --.

Column 16, line 37, "pet)" should read -- p(t) --.

Column 17, line 5, "throuhbore" should read -- throughbore --.

Column 17, line 45, the phrase "and "ϵ" where "ϵ" is" should read -- and "ε" where "ε" is --.

Column 17, line 50, "ϵ" should read -- "ε" --.

Column 18, line 18, "Ps and "E"" should read -- Ps and "ε" --.

Column 18, line 19, "E" should read -- "ε" --.

Signed and Sealed this

Twenty-ninth Day of June, 2010

David J. Kappos

David J. Kappos
*Director of the United States Patent and Trademark Office*